US008408792B2

(12) United States Patent
Cole et al.

(10) Patent No.: US 8,408,792 B2
(45) Date of Patent: Apr. 2, 2013

(54) PACKAGE INTEGRITY INDICATING CLOSURE

(75) Inventors: Carole A. Cole, Budd Lake, NJ (US); Jeffrey Thomas Weber, Lake Zurich, IL (US)

(73) Assignee: Kraft Foods Global Brands LLC, Deerfield, IL (US)

( * ) Notice: Subject to any disclaimer, the term of this patent is extended or adjusted under 35 U.S.C. 154(b) by 1417 days.

(21) Appl. No.: 11/693,751

(22) Filed: Mar. 30, 2007

(65) Prior Publication Data

US 2008/0240627 A1 Oct. 2, 2008

(51) Int. Cl.
*B65D 33/00* (2006.01)
*B65D 33/14* (2006.01)
*B65D 33/04* (2006.01)

(52) U.S. Cl. ..... 383/203; 383/5; 383/211; 383/106

(58) Field of Classification Search ..... 383/203, 383/204, 210, 5, 211, 106; 229/102, 80
See application file for complete search history.

(56) References Cited

U.S. PATENT DOCUMENTS

| | | | | |
|---|---|---|---|---|
| 811,092 | A * | 1/1906 | Roberts | 229/81 |
| 1,065,012 | A * | 6/1913 | Watanabe | 229/81 |
| 1,106,721 | A * | 8/1914 | Lewis | 229/81 |
| 1,171,462 | A | 2/1916 | Rice | |
| 1,791,352 | A * | 2/1931 | Colonnese | 229/79 |
| 1,963,639 | A * | 6/1934 | Ahlquist | 229/80 |
| 1,978,035 | A | 10/1934 | Thom | |
| 2,066,495 | A * | 1/1937 | Swift | 229/80 |
| 2,128,196 | A | 8/1938 | Vogel | |
| 2,475,236 | A | 7/1949 | Gollab | |
| 2,554,160 | A | 5/1951 | Von Gunten | |
| 2,605,897 | A | 8/1952 | Rundle | |
| 2,684,807 | A | 7/1954 | Gerrish | |

(Continued)

FOREIGN PATENT DOCUMENTS

| | | |
|---|---|---|
| AU | 768679 | 6/2001 |
| AU | 2002334419 | 5/2003 |

(Continued)

OTHER PUBLICATIONS

Patent Abstracts of Japan, vol. 1997 No. 10, Oct. 31, 1997 & JP09156677 A (Fuji Seal Col Ltd.), (Jul. 6, 1997) abstract in English and 7 figures.

(Continued)

*Primary Examiner* — Jes F Pascua
(74) *Attorney, Agent, or Firm* — Fitch, Even, Tabin & Flannery LLP

(57) ABSTRACT

A resealable closure for a container in which package integrity is indicated by a structure which breaks and/or produces an audible sound when the resealable closure is opened for a first time. The package integrity feature, in one form includes at least one strip initially affixed to two portions which comprise the resealable closure so that upon opening the resealable closure for a first time, at least one of the strips breaks, thereby producing the audible sound. The strips may include a weakened portion such as a narrowing. Integrity of the package is indicated by an intact strip viewable upon opening the resealable closure and conversely, a broken or non-intact strip would indicate that the resealable closure has been previously opened. Package integrity may also be shown by a movable second panel or movable die cut tab portions.

32 Claims, 11 Drawing Sheets

U.S. PATENT DOCUMENTS

| | | | | | |
|---|---|---|---|---|---|
| 2,965,224 | A | | 12/1960 | Harwood | |
| 3,080,238 | A | | 3/1963 | Kraft et al. | |
| 3,127,273 | A | | 3/1964 | Monoham | |
| 3,179,326 | A | | 4/1965 | Underwood et al. | |
| 3,186,628 | A | | 6/1965 | Rohde | |
| 3,187,982 | A | | 6/1965 | Underwood et al. | |
| 3,217,871 | A | | 11/1965 | Lee | |
| 3,235,165 | A | | 2/1966 | Jackson | |
| 3,259,303 | A | | 7/1966 | Repko | |
| 3,260,358 | A | | 7/1966 | Gottily et al. | |
| 3,272,422 | A | | 9/1966 | Miller | |
| 3,311,032 | A | | 3/1967 | Lucas | |
| 3,326,450 | A | | 6/1967 | Langdon | |
| 3,331,501 | A | | 7/1967 | Steward, Jr. | |
| 3,343,541 | A | | 9/1967 | Bellemy, Jr. | |
| 3,373,926 | A | | 3/1968 | Voightman, Sr. et al. | |
| 3,454,210 | A | | 7/1969 | Spiegel et al. | |
| 3,528,825 | A | | 9/1970 | Doughty | |
| 3,570,751 | A | | 3/1971 | Trewella | |
| 3,595,466 | A | | 7/1971 | Rosenburg, Jr. | |
| 3,595,468 | A | | 7/1971 | Repko | |
| 3,618,751 | A | | 11/1971 | Rich | |
| 3,630,346 | A | | 12/1971 | Burnside | |
| 3,651,615 | A | | 3/1972 | Bohner et al. | |
| 3,653,502 | A | | 4/1972 | Beaudoin | |
| 3,687,352 | A | | 8/1972 | Kalajian | |
| 3,740,238 | A | | 6/1973 | Graham | |
| 3,757,078 | A | | 9/1973 | Conti et al. | |
| 3,790,744 | A | | 2/1974 | Bowen | |
| 3,885,727 | A | | 5/1975 | Gilley | |
| 3,905,646 | A | | 9/1975 | Brackmann et al. | |
| 3,909,582 | A | | 9/1975 | Bowen | |
| 3,910,410 | A | | 10/1975 | Shaw | |
| 3,938,659 | A | * | 2/1976 | Wardwell | 206/439 |
| 3,966,046 | A | | 6/1976 | Deutschlander | |
| 3,971,506 | A | | 7/1976 | Roenna | |
| 4,113,104 | A | | 9/1978 | Meyers | |
| 4,140,046 | A | | 2/1979 | Marbach | |
| 4,156,493 | A | | 5/1979 | Julius | |
| 4,185,754 | A | | 1/1980 | Julius | |
| 4,192,420 | A | | 3/1980 | Worrell et al. | |
| 4,192,448 | A | * | 3/1980 | Porth | 229/80 |
| 4,197,949 | A | | 4/1980 | Carlsson | |
| 4,258,876 | A | | 3/1981 | Ljungcrantz | |
| 4,260,061 | A | | 4/1981 | Jacobs | |
| 4,273,815 | A | | 6/1981 | Gifford et al. | |
| 4,285,681 | A | | 8/1981 | Walitalo | |
| 4,306,367 | A | | 12/1981 | Otto | |
| 4,327,862 | A | | 5/1982 | Jakobs | |
| 4,337,862 | A | | 7/1982 | Suter | |
| 4,364,478 | A | | 12/1982 | Tuns | |
| 4,397,415 | A | | 8/1983 | Lisiecki | |
| 4,411,365 | A | | 10/1983 | Horikawa et al. | |
| 4,420,080 | A | | 12/1983 | Nakamura | |
| 4,428,477 | A | | 1/1984 | Cristofolo | |
| 4,464,154 | A | | 8/1984 | Ljungcrantz | |
| 4,488,647 | A | | 12/1984 | Davis | |
| 4,518,087 | A | | 5/1985 | Goglio | |
| 4,538,396 | A | | 9/1985 | Nakamura | |
| 4,545,844 | A | | 10/1985 | Buchanan | |
| 4,548,824 | A | | 10/1985 | Mitchell et al. | |
| 4,548,852 | A | | 10/1985 | Mitchell | |
| 4,549,063 | A | | 10/1985 | Ang et al. | |
| 4,550,831 | A | | 11/1985 | Whitford | |
| 4,552,269 | A | | 11/1985 | Chang | |
| 4,557,505 | A | | 12/1985 | Schaefer et al. | |
| 4,570,820 | A | | 2/1986 | Murphy | |
| 4,572,377 | A | | 2/1986 | Beckett | |
| 4,608,288 | A | | 8/1986 | Spindler | |
| 4,610,357 | A | | 9/1986 | Nakamura | |
| 4,613,046 | A | | 9/1986 | Kuchenbecker | |
| 4,616,470 | A | | 10/1986 | Nakamura | |
| 4,625,495 | A | | 12/1986 | Holovach | |
| 4,638,911 | A | | 1/1987 | Prohaska | |
| 4,648,509 | A | | 3/1987 | Alves | |
| 4,651,874 | A | | 3/1987 | Nakamura | |
| 4,653,250 | A | | 3/1987 | Nakamura | |
| 4,658,963 | A | | 4/1987 | Jud | |
| 4,667,453 | A | | 5/1987 | Goglio | |
| 4,671,453 | A | | 6/1987 | Cassidy | |
| 4,673,085 | A | | 6/1987 | Badouard et al. | |
| 4,679,693 | A | * | 7/1987 | Forman | 383/203 |
| 4,694,960 | A | | 9/1987 | Phipps et al. | |
| 4,696,404 | A | | 9/1987 | Corella | |
| 4,723,301 | A | | 2/1988 | Chang | |
| 4,738,365 | A | * | 4/1988 | Prater | 229/123.3 |
| 4,739,879 | A | | 4/1988 | Nakamura | |
| 4,784,885 | A | | 11/1988 | Carespodi | |
| 4,790,436 | A | | 12/1988 | Nakamura | |
| 4,798,295 | A | | 1/1989 | Rausing | |
| 4,798,296 | A | | 1/1989 | Lagerstedt et al. | |
| 4,799,594 | A | | 1/1989 | Blackman | |
| 4,811,848 | A | | 3/1989 | Jud | |
| 4,818,120 | A | | 4/1989 | Addiego | |
| 4,838,429 | A | | 6/1989 | Fabisiewicz et al. | |
| 4,840,270 | A | | 6/1989 | Caputo et al. | |
| 4,845,470 | A | | 7/1989 | Boldt et al. | |
| 4,848,575 | A | | 7/1989 | Nakamura et al. | |
| 4,863,064 | A | | 9/1989 | Dailey, III | |
| 4,865,198 | A | | 9/1989 | Butler | |
| 4,866,911 | A | | 9/1989 | Grindrod et al. | |
| 4,874,096 | A | * | 10/1989 | Tessera-Chiesa | 383/5 |
| 4,876,123 | A | | 10/1989 | Rivera et al. | |
| 4,889,731 | A | | 12/1989 | Williams, Jr. | |
| 4,901,505 | A | | 2/1990 | Williams, Jr. | |
| 4,902,142 | A | | 2/1990 | Lammert et al. | |
| 4,917,247 | A | | 4/1990 | Jud | |
| 4,943,439 | A | | 7/1990 | Andreas et al. | |
| 4,972,953 | A | * | 11/1990 | Friedman et al. | 206/459.1 |
| 4,998,666 | A | | 3/1991 | Ewan | |
| 4,999,081 | A | | 3/1991 | Buchanan | |
| 5,000,320 | A | | 3/1991 | Kuchenbecker | |
| 5,005,264 | A | | 4/1991 | Breen | |
| 5,018,625 | A | | 5/1991 | Focke et al. | |
| 5,029,712 | A | | 7/1991 | O'Brien et al. | |
| 5,040,685 | A | | 8/1991 | Focke et al. | |
| 5,046,621 | A | | 9/1991 | Bell | |
| 5,048,718 | A | | 9/1991 | Nakamura | |
| 5,060,848 | A | | 10/1991 | Ewan | |
| 5,065,868 | A | | 11/1991 | Cornelissen et al. | |
| 5,076,439 | A | | 12/1991 | Kuchenbecker | |
| 5,077,064 | A | | 12/1991 | Hustad et al. | |
| 5,078,509 | A | | 1/1992 | Center et al. | |
| 5,082,702 | A | | 1/1992 | Alband | |
| 5,085,724 | A | | 2/1992 | Focke | |
| 5,096,113 | A | | 3/1992 | Focke | |
| 5,100,003 | A | | 3/1992 | Jud | |
| 5,103,980 | A | | 4/1992 | Kuchenbecker | |
| 5,124,388 | A | | 6/1992 | Pruett et al. | |
| 5,125,211 | A | | 6/1992 | O'Brien et al. | |
| 5,134,001 | A | | 7/1992 | Osgood | |
| 5,158,499 | A | | 10/1992 | Guckenberger | |
| 5,161,350 | A | | 11/1992 | Nakamura | |
| 5,167,974 | A | | 12/1992 | Grindrod et al. | |
| 5,174,659 | A | | 12/1992 | Laske | |
| 5,184,771 | A | | 2/1993 | Jud et al. | |
| 5,197,618 | A | | 3/1993 | Goth | |
| 5,222,422 | A | | 6/1993 | Benner, Jr. et al. | |
| 5,222,813 | A | | 6/1993 | Kopp et al. | |
| 5,294,470 | A | | 3/1994 | Ewan | |
| 5,307,988 | A | | 5/1994 | Focke et al. | |
| 5,333,735 | A | | 8/1994 | Focke et al. | |
| 5,344,007 | A | | 9/1994 | Nakamura et al. | |
| 5,352,466 | A | | 10/1994 | Delonis | |
| 5,356,068 | A | | 10/1994 | Moreno | |
| 5,366,087 | A | | 11/1994 | Bane | |
| 5,371,997 | A | | 12/1994 | Kopp et al. | |
| 5,374,179 | A | | 12/1994 | Swanson | |
| 5,375,698 | A | | 12/1994 | Ewart et al. | |
| 5,381,643 | A | | 1/1995 | Kazaitis et al. | |
| 5,382,190 | A | | 1/1995 | Graves | |
| 5,388,757 | A | | 2/1995 | Lorenzen | |
| 5,405,629 | A | | 4/1995 | Marnocha et al. | |
| 5,407,070 | A | | 4/1995 | Bascos et al. | |
| 5,409,115 | A | | 4/1995 | Barkhorn | |
| 5,409,116 | A | | 4/1995 | Aronsen | |
| 5,454,207 | A | | 10/1995 | Storandt | |

5,460,838 A 10/1995 Wermund
5,460,844 A 10/1995 Gaylor
5,461,845 A * 10/1995 Yeager ..... 53/451
5,464,092 A 11/1995 Seeley
5,470,015 A 11/1995 Jud
5,489,060 A 2/1996 Godard
5,499,757 A 3/1996 Back
5,503,858 A 4/1996 Reskow
5,505,305 A * 4/1996 Scholz et al. ..... 206/438
5,515,965 A 5/1996 Boldrini et al.
5,519,982 A 5/1996 Herber et al.
5,520,939 A 5/1996 Wells
5,524,759 A 6/1996 Herzberg et al.
5,531,325 A 7/1996 Deflander et al.
5,538,129 A 7/1996 Chester et al.
5,550,346 A 8/1996 Andriash et al.
5,558,438 A 9/1996 Warr
5,582,342 A 12/1996 Jud
5,582,853 A 12/1996 Marnocha et al.
5,582,887 A 12/1996 Etheredge
5,591,468 A 1/1997 Stockley, III et al.
5,630,308 A 5/1997 Guckenberger
5,633,058 A 5/1997 Hoffer et al.
5,637,369 A 6/1997 Stewart
5,647,100 A 7/1997 Porchia et al.
5,647,506 A 7/1997 Julius
5,664,677 A 9/1997 O'Connor
5,688,394 A 11/1997 McBride, Jr. et al.
5,688,463 A 11/1997 Robichaud et al.
5,702,743 A 12/1997 Wells
5,709,479 A 1/1998 Bell
5,725,311 A 3/1998 Ponsi et al.
D394,605 S 5/1998 Skiba et al.
5,749,657 A 5/1998 May
5,770,283 A 6/1998 Gosselin et al.
5,791,465 A 8/1998 Niki et al.
5,795,604 A 8/1998 Wells et al.
5,820,953 A 10/1998 Beer et al.
5,833,368 A 11/1998 Kaufman
5,855,435 A 1/1999 Chiesa
5,862,101 A 1/1999 Haas et al.
5,873,483 A 2/1999 Gortz et al.
5,873,607 A 2/1999 Waggoner
5,882,116 A 3/1999 Backus
5,885,673 A 3/1999 Light et al.
5,906,278 A 5/1999 Ponsi et al.
5,908,246 A 6/1999 Arimura et al.
5,928,749 A 7/1999 Forman
5,938,013 A 8/1999 Palumbo et al.
5,939,156 A 8/1999 Rossi et al.
5,945,145 A 8/1999 Narsutis et al.
5,956,794 A 9/1999 Skiba et al.
5,993,962 A 11/1999 Timm et al.
5,996,797 A 12/1999 Flaig
5,997,177 A 12/1999 Kaufman
6,015,934 A 1/2000 Lee et al.
6,026,953 A * 2/2000 Nakamura et al. ..... 206/233
6,028,289 A 2/2000 Robichaud et al.
6,029,809 A 2/2000 Skiba et al.
6,056,141 A 5/2000 Navarini et al.
6,060,095 A 5/2000 Scrimager
6,065,591 A 5/2000 Dill et al.
6,066,437 A 5/2000 Kosslinger
6,076,969 A 6/2000 Jaisle et al.
6,077,551 A 6/2000 Scrimager
6,099,682 A 8/2000 Krampe et al.
6,113,271 A 9/2000 Scott et al.
6,125,614 A 10/2000 Jones et al.
6,126,009 A 10/2000 Shiffler et al.
6,126,317 A 10/2000 Anderson et al.
6,152,601 A 11/2000 Johnson
6,164,441 A 12/2000 Guy et al.
6,213,645 B1 4/2001 Beer
6,228,450 B1 5/2001 Pedrini
D447,054 S 8/2001 Hill
6,273,610 B1 8/2001 Koyama et al.
6,279,297 B1 8/2001 Latronico
6,296,884 B1 10/2001 Okerlund
6,299,355 B1 10/2001 Schneck
6,309,104 B1 10/2001 Koch et al.
6,309,105 B1 10/2001 Palumbo
6,318,894 B1 11/2001 Derenthal
6,352,364 B1 3/2002 Mobs
6,364,113 B1 4/2002 Faasse, Jr. et al.
6,365,255 B1 4/2002 Kittel et al.
6,383,592 B1 5/2002 Lowry et al.
6,402,379 B1 6/2002 Albright
6,420,006 B1 7/2002 Scott
6,427,420 B1 8/2002 Olivieri et al.
6,428,867 B1 * 8/2002 Scott et al. ..... 428/40.1
6,446,811 B1 9/2002 Wilfong, Jr.
6,450,685 B1 9/2002 Scott
6,457,585 B1 10/2002 Huffer et al.
6,461,043 B1 10/2002 Healy et al.
6,461,708 B1 10/2002 Dronzek
6,471,817 B1 10/2002 Emmert
6,476,743 B1 11/2002 Brown et al.
6,482,867 B1 11/2002 Kimura et al.
6,502,986 B1 1/2003 Bensur et al.
6,517,243 B2 2/2003 Huffer et al.
6,538,581 B2 3/2003 Cowie
6,539,691 B2 4/2003 Beer
6,554,134 B1 4/2003 Guibert
6,563,082 B2 5/2003 Terada et al.
6,589,622 B1 * 7/2003 Scott ..... 428/40.1
6,592,260 B1 7/2003 Randall et al.
6,594,872 B2 7/2003 Cisek
6,616,334 B2 9/2003 Faaborg et al.
6,621,046 B2 9/2003 Kaji
6,669,046 B1 12/2003 Sawada et al.
6,691,886 B1 2/2004 Berndt et al.
6,698,928 B2 3/2004 Miller
6,726,054 B2 4/2004 Fagen et al.
6,726,364 B2 4/2004 Perell et al.
6,746,743 B2 6/2004 Knoerzer et al.
6,750,423 B2 6/2004 Tanaka et al.
6,767,604 B2 * 7/2004 Muir et al. ..... 428/40.1
6,815,634 B2 11/2004 Sonoda et al.
6,852,947 B2 2/2005 Tanaka
6,865,860 B2 3/2005 Arakawa et al.
6,889,483 B2 5/2005 Compton et al.
6,918,532 B2 * 7/2005 Sierra-Gomez et al. ... 229/87.08
6,929,400 B2 8/2005 Razeti et al.
6,951,999 B2 10/2005 Monforton et al.
6,969,196 B2 11/2005 Woodham et al.
6,983,875 B2 * 1/2006 Emmott ..... 229/313
7,007,423 B2 3/2006 Andersson et al.
7,021,827 B2 4/2006 Compton et al.
7,032,757 B2 4/2006 Richards et al.
7,040,810 B2 5/2006 Steele
7,048,441 B2 5/2006 Pape
7,051,877 B2 5/2006 Lin
7,165,888 B2 * 1/2007 Rodick ..... 383/211
7,172,779 B2 2/2007 Castellanos et al.
7,207,718 B2 4/2007 Machacek
7,207,719 B2 4/2007 Marbler et al.
7,213,710 B2 5/2007 Cotert
7,228,968 B1 6/2007 Burgess
7,254,873 B2 8/2007 Stolmeier et al.
7,261,468 B2 8/2007 Schneider et al.
7,262,335 B2 8/2007 Motsch et al.
7,302,783 B2 12/2007 Cotert
7,344,744 B2 * 3/2008 Sierra-Gomez et al. ..... 426/119
7,350,688 B2 * 4/2008 Sierra-Gomez et al. ... 229/87.08
7,351,458 B2 4/2008 Leighton
7,352,591 B2 4/2008 Sugahara
7,371,008 B2 * 5/2008 Bonenfant ..... 383/5
7,404,487 B2 7/2008 Kumakura et al.
7,422,142 B2 9/2008 Arippol
7,470,062 B2 12/2008 Moteki et al.
7,475,781 B2 1/2009 Kobayashi et al.
7,516,599 B2 4/2009 Doll
7,533,773 B2 5/2009 Aldridge et al.
7,600,641 B2 10/2009 Burgess
7,703,602 B2 4/2010 Saito et al.
7,708,463 B2 5/2010 Sampaio Camacho
7,717,620 B2 5/2010 Hebert et al.
7,740,923 B2 6/2010 Exner et al.

| | | | | |
|---|---|---|---|---|
| 7,744,517 | B2 | 6/2010 | Bonenfant | |
| 7,758,484 | B2 | 7/2010 | Peterson | |
| 7,858,901 | B2 | 12/2010 | Krishnan et al. | |
| 7,963,413 | B2 | 6/2011 | Sierra-Gomez et al. | |
| 7,971,718 | B2 | 7/2011 | Aldridge | |
| 8,002,171 | B2 | 8/2011 | Ryan et al. | |
| 8,002,941 | B2 | 8/2011 | Exner et al. | |
| 8,038,349 | B2 | 10/2011 | Andersson et al. | |
| 8,114,451 | B2 | 2/2012 | Sierra-Gomez et al. | |
| 8,181,784 | B2 | 5/2012 | Bouthiette | |
| 8,240,546 | B2 | 8/2012 | Friebe et al. | |
| 2001/0000480 | A1 | 4/2001 | Stagg et al. | |
| 2002/0068668 | A1 | 6/2002 | Chow et al. | |
| 2003/0002753 | A1* | 1/2003 | Stolmeier et al. | 383/64 |
| 2003/0019780 | A1 | 1/2003 | Parodi et al. | |
| 2003/0039412 | A1 | 2/2003 | Rodick | |
| 2003/0047695 | A1 | 3/2003 | Zik et al. | |
| 2003/0051440 | A1 | 3/2003 | Chow et al. | |
| 2003/0118255 | A1 | 6/2003 | Miller | |
| 2003/0127352 | A1 | 7/2003 | Buschkiel et al. | |
| 2003/0183637 | A1 | 10/2003 | Zappa et al. | |
| 2003/0183643 | A1 | 10/2003 | Fagen et al. | |
| 2003/0210838 | A1 | 11/2003 | Steele | |
| 2003/0223656 | A1 | 12/2003 | Razeti et al. | |
| 2004/0011677 | A1 | 1/2004 | Arakawa et al. | |
| 2004/0035719 | A1 | 2/2004 | Ebbers et al. | |
| 2004/0060974 | A1* | 4/2004 | Dacey | 229/225 |
| 2004/0062838 | A1 | 4/2004 | Castellanos et al. | |
| 2004/0067326 | A1 | 4/2004 | Knoerzer et al. | |
| 2004/0083680 | A1 | 5/2004 | Compton et al. | |
| 2004/0091184 | A1 | 5/2004 | Miller | |
| 2004/0112010 | A1 | 6/2004 | Richards et al. | |
| 2004/0150221 | A1 | 8/2004 | Brown | |
| 2004/0175060 | A1 | 9/2004 | Woodham et al. | |
| 2004/0180118 | A1 | 9/2004 | Renger et al. | |
| 2004/0206637 | A1 | 10/2004 | Sierra-Gomez et al. | |
| 2005/0000965 | A1 | 1/2005 | Boardman | |
| 2005/0084186 | A1 | 4/2005 | Caris | |
| 2005/0117819 | A1 | 6/2005 | Kingsford et al. | |
| 2005/0220371 | A1 | 10/2005 | Machacek | |
| 2005/0247764 | A1* | 11/2005 | Sierra-Gomez et al. | 229/87.08 |
| 2005/0276525 | A1* | 12/2005 | Hebert et al. | 383/203 |
| 2005/0276885 | A1 | 12/2005 | Bennett | |
| 2005/0284776 | A1 | 12/2005 | Kobayashi et al. | |
| 2006/0018569 | A1 | 1/2006 | Bonenfant | |
| 2006/0066096 | A1 | 3/2006 | Kan | |
| 2006/0124494 | A1 | 6/2006 | Clark, Jr. et al. | |
| 2006/0144911 | A1 | 7/2006 | Sierra-Gomez et al. | |
| 2006/0171611 | A1* | 8/2006 | Rapparini | 383/66 |
| 2006/0199717 | A1 | 9/2006 | Marbler et al. | |
| 2006/0251342 | A1 | 11/2006 | Forman | |
| 2006/0257056 | A1 | 11/2006 | Miyake et al. | |
| 2006/0257599 | A1 | 11/2006 | Exner et al. | |
| 2006/0285779 | A1 | 12/2006 | Golas | |
| 2007/0023435 | A1* | 2/2007 | Sierra-Gomez et al. | 220/359.2 |
| 2007/0023436 | A1 | 2/2007 | Sierra-Gomez et al. | |
| 2007/0095709 | A1 | 5/2007 | Saito et al. | |
| 2007/0140600 | A1 | 6/2007 | Nowak et al. | |
| 2007/0209959 | A1 | 9/2007 | Burgess | |
| 2007/0269142 | A1 | 11/2007 | Tyska et al. | |
| 2007/0275133 | A1* | 11/2007 | Sierra-Gomez et al. | 426/122 |
| 2008/0013869 | A1 | 1/2008 | Forman | |
| 2008/0031555 | A1 | 2/2008 | Roberts | |
| 2008/0037911 | A1* | 2/2008 | Cole et al. | 383/203 |
| 2008/0041750 | A1 | 2/2008 | Kohlweyer | |
| 2008/0053861 | A1 | 3/2008 | Mellin | |
| 2008/0060751 | A1 | 3/2008 | Arrindell | |
| 2008/0063324 | A1 | 3/2008 | Bernard et al. | |
| 2008/0063759 | A1 | 3/2008 | Raymond et al. | |
| 2008/0063760 | A1 | 3/2008 | Raymond et al. | |
| 2008/0131035 | A1 | 6/2008 | Rogers | |
| 2008/0135428 | A1 | 6/2008 | Tallier | |
| 2008/0152264 | A1 | 6/2008 | Pokusa et al. | |
| 2008/0156861 | A1* | 7/2008 | Sierra-Gomez et al. | 229/214 |
| 2008/0159666 | A1 | 7/2008 | Exner et al. | |
| 2008/0203141 | A1 | 8/2008 | Friebe et al. | |
| 2008/0214376 | A1 | 9/2008 | Bonenfant | |
| 2008/0240627 | A1 | 10/2008 | Cole et al. | |
| 2008/0273821 | A1 | 11/2008 | Doll | |
| 2008/0292225 | A1 | 11/2008 | Dayrit et al. | |
| 2009/0001143 | A1 | 1/2009 | Cowan et al. | |
| 2009/0014491 | A1 | 1/2009 | Fuisz et al. | |
| 2009/0022431 | A1 | 1/2009 | Conner | |
| 2009/0028472 | A1 | 1/2009 | Andersson et al. | |
| 2009/0053372 | A1 | 2/2009 | Hambrick et al. | |
| 2009/0074333 | A1 | 3/2009 | Griebel et al. | |
| 2009/0097786 | A1 | 4/2009 | Goglio et al. | |
| 2009/0190866 | A1 | 7/2009 | Hughes | |
| 2009/0211938 | A1 | 8/2009 | Aldridge | |
| 2009/0226117 | A1 | 9/2009 | Davis et al. | |
| 2009/0273179 | A1 | 11/2009 | Scott et al. | |
| 2010/0002963 | A1 | 1/2010 | Holbert et al. | |
| 2010/0018974 | A1 | 1/2010 | Lyzenga et al. | |
| 2010/0019022 | A1 | 1/2010 | Ryan et al. | |
| 2010/0111453 | A1 | 5/2010 | Dierl | |
| 2010/0113241 | A1 | 5/2010 | Hebert et al. | |
| 2010/0172604 | A1 | 7/2010 | Andersson et al. | |
| 2010/0226598 | A1 | 9/2010 | Stoeppelmann | |
| 2010/0230303 | A1 | 9/2010 | Buse et al. | |
| 2010/0278454 | A1 | 11/2010 | Huffer | |
| 2010/0303391 | A9 | 12/2010 | Cole et al. | |
| 2011/0049158 | A1 | 3/2011 | Bouthiette | |
| 2011/0127319 | A1 | 6/2011 | Golden | |
| 2011/0132976 | A1 | 6/2011 | Drewnowski et al. | |
| 2011/0147443 | A1 | 6/2011 | Igo | |

FOREIGN PATENT DOCUMENTS

| | | | |
|---|---|---|---|
| AU | 2004295316 | | 6/2005 |
| AU | 2005254459 | | 12/2005 |
| BR | DI 5500885-2 | F | 11/2001 |
| BR | DI 6206030-7 | F | 4/2003 |
| BR | DI 6804636-7 | F | 10/2009 |
| DE | 1848870 | | 3/1962 |
| DE | 9014065 | | 4/1991 |
| DE | 4134567 | | 10/1991 |
| DE | 4241423 | | 6/1994 |
| DE | 4241423 | | 8/1994 |
| DE | 19738411 | | 3/1999 |
| DE | 19738411 | | 4/1999 |
| DE | 19822328 | | 11/1999 |
| DE | 10 2007 030267 | | 1/2009 |
| EP | 0085289 | | 8/1983 |
| EP | 388310 | | 3/1990 |
| EP | 0474981 | | 3/1992 |
| EP | 0488967 | | 6/1992 |
| EP | 474981 | | 9/1992 |
| EP | 0546369 | | 6/1993 |
| EP | 0447636 | | 3/1994 |
| EP | 0608909 | | 8/1994 |
| EP | 0613824 | | 9/1994 |
| EP | 0629561 | | 12/1994 |
| EP | 0661154 | | 7/1995 |
| EP | 0667828 | | 8/1995 |
| EP | 0669204 | B1 | 8/1995 |
| EP | 0669204 | B2 | 8/1995 |
| EP | 0752375 | | 8/1997 |
| EP | 0796208 | | 9/1997 |
| EP | 0758993 | | 3/1998 |
| EP | 0905048 | | 3/1999 |
| EP | 0744357 | | 10/2000 |
| EP | 1046594 | | 10/2000 |
| EP | 1056066 | | 11/2000 |
| EP | 1449789 | | 2/2003 |
| EP | 1350741 | | 10/2003 |
| EP | 1375380 | | 1/2004 |
| EP | 1382543 | | 1/2004 |
| EP | 1437311 | | 7/2004 |
| EP | 1457424 | | 9/2004 |
| EP | 1468936 | | 10/2004 |
| EP | 1477425 | | 11/2004 |
| EP | 1488936 | | 12/2004 |
| EP | 1086906 | | 5/2005 |
| EP | 1608567 | | 12/2005 |
| EP | 1609737 | | 12/2005 |
| EP | 1609737 | | 1/2006 |
| EP | 1619137 | | 1/2006 |
| EP | 1637472 | | 3/2006 |
| EP | 1697230 | | 9/2006 |

| | | |
|---|---|---|
| EP | 1712468 | 10/2006 |
| EP | 1755980 | 2/2007 |
| EP | 1760006 | 3/2007 |
| EP | 1770025 | 4/2007 |
| EP | 1608567 | 7/2007 |
| EP | 1975081 | 1/2008 |
| EP | 1939107 | 2/2008 |
| EP | 1908696 | 9/2008 |
| EP | 1858776 | 10/2008 |
| EP | 1712488 | 12/2008 |
| EP | 1846306 | 3/2009 |
| EP | 2033910 | 3/2009 |
| EP | 2189506 | 5/2010 |
| FR | 1327914 | 4/1963 |
| FR | 2674509 | 10/1992 |
| FR | 2674509 | 2/1995 |
| FR | 2766794 | 2/1999 |
| FR | 2783512 | 3/2000 |
| GB | 2276095 | 9/1994 |
| JP | 57-163658 | 10/1982 |
| JP | 60080405 | 5/1985 |
| JP | 62171479 | 10/1987 |
| JP | 63-022370 | 1/1988 |
| JP | 9150872 | 6/1997 |
| JP | 09156677 | 6/1997 |
| JP | 10059441 | 3/1998 |
| JP | 10129685 | 5/1998 |
| JP | 1998-152179 | 9/1998 |
| JP | 10-120016 | 12/1998 |
| JP | 11198977 | 7/1999 |
| JP | 2000335542 | 12/2000 |
| JP | 2001-114357 | 4/2001 |
| JP | 2003-26224 | 1/2003 |
| JP | 2003072774 | 3/2003 |
| JP | 2006062712 | 3/2006 |
| JP | 2007045434 | 2/2007 |
| NZ | 555274 | 12/2008 |
| WO | 8606350 | 11/1986 |
| WO | 94/11270 | 5/1994 |
| WO | 9532902 | 12/1995 |
| WO | 9725200 | 7/1997 |
| WO | 01/40073 | 6/2001 |
| WO | 0140073 | 6/2001 |
| WO | 02/064365 | 8/2002 |
| WO | 02/066341 | 8/2002 |
| WO | 2002/064365 | 8/2002 |
| WO | 03/013976 | 2/2003 |
| WO | 03/037727 | 5/2003 |
| WO | 03/059776 | 7/2003 |
| WO | 2004/087527 | 10/2004 |
| WO | 2005/506420 | 6/2005 |
| WO | 2005/110042 | 11/2005 |
| WO | 2005/110865 | 11/2005 |
| WO | 2005/110876 | 11/2005 |
| WO | 2005/110885 | 11/2005 |
| WO | 2005/120989 | 12/2005 |
| WO | 2005/123535 | 12/2005 |
| WO | 2006/055128 | 5/2006 |
| WO | 2006/108614 | 10/2006 |
| WO | 2007090419 | 8/2007 |
| WO | 2008/062159 | 5/2008 |
| WO | 2008051813 | 5/2008 |
| WO | 2006080405 | 6/2008 |
| WO | 2008074060 | 6/2008 |
| WO | 2008108969 | 9/2008 |
| WO | 2008115693 | 9/2008 |
| WO | 2008122961 | 10/2008 |
| WO | 2009065120 | 5/2009 |
| WO | 2009111153 | 9/2009 |
| WO | 2010002834 | 1/2010 |
| WO | 2010080810 | 1/2010 |
| WO | 2010/046623 | 4/2010 |
| WO | 2010/051146 | 5/2010 |
| WO | 2010/084336 | 7/2010 |
| WO | 2010/088492 | 8/2010 |
| WO | 2010/114879 | 10/2010 |
| WO | 2010/149996 | 12/2010 |
| WO | 2011/004156 | 1/2011 |
| WO | 2011/121337 | 10/2011 |

OTHER PUBLICATIONS

"Elite Edam Cheese", Mintel gnpd, Dec. 3, 2001, Mintel Publishing.
"New Easy Peel Cheese Packaging", Mintel gnpd, Aug. 10, 2001, Mintel Publishing.
"Cheese Range", Mintel gnpd, Jan. 26, 2001, Mintel Publishing.
"Soft Bread Sticks", Mintel gnpd, Mar. 20, 1998, Mintel Publishing.
"New on the Shelf—Product Instructions and Packaging Trends", Circle Reader Service Card No. 93, Aug. 1998, Baking & Snack.
Machinery Update, Mar./Apr. 2002, pp. 59-60.
Reclosure system lengthens food life, Packaging News PPMA Preview, Sep. 2001, p. 40.
U.S. Appl. No. 11/500,497, Cole et al.
Giant™ Baby Wipes package, item No., 80203-91, resealable package having die cut-out portions (tabs) which remain affixed to the top of the package after label is withdrawn from the top, whereby tamper evidence is indicated by a misalignment of the die cut-out portions with the holes formed in the label.
Reseal-it. [Homepage of Macfarlane Group] [Online] 2005. Available at: http//www.reseal-it.se [accessed Mar. 14, 2005].
Reseal-It. Web page Internet print out accesed Mar. 14, 2005; 11 pages.
"margin," Merriam-Webster Online Dictionary, 2010, Merriam-Webster [online], retrieved on May 6, 2010. Retrieved from the internet; URL: <http://www.merriam-webster.com/dictionary.com/dictionary/margin>.
European Patent No. 1679269 opposition documents, dated Apr. 30, 2012.
European Patent No. 1679269 opposition documents, dated May 2, 2012.
Japanese Office Action translation, Japanese Patent Application No. 2009-172352, mailed Feb. 14, 2012.
Machinery Update, Mar./Apr. 2002, pp. 56-62.
English Translation of JP H09-156677 published Jun. 17, 1995.
English Translation of JP S60-80405 published Aug. 5, 1985.
English Translation of JP Official Notice of Rejection mailed on Feb. 14, 2012 in JP Appl. No. 2009-172352, 3 pages.
English Translation of JP 2003-26224 published on Jan. 29, 2003.
English Translation of JP 1998-152179 published on Sep. 6, 1998.
English Translation of JP 2001-114357 published on Apr. 24, 2001.
Fuji Packaging GmbH Fachpack brochure, Oct. 11-12, 2001, 2 pages.
European Packaging Pack Report, NR. 5 Mai 2001 and partial translation thereof, 6 pages.
Machinery Update, Sep./Oct. 2001, pp. 46-47.
English Translation of BR DI 6202030-7 F, Published Apr. 15, 2003.
English Translation of BR DI 6804636-7 F, Published Oct. 20, 2009.
English Translation of BR DI 5500885-2 F, Published Nov. 20, 2001.
European Search Report, EP10305289 citing DE1848870U, no date provided.

* cited by examiner

PACKAGE INTEGRITY INDICATING CLOSURE

FIELD OF THE INVENTION

The present invention relates to a resealable closure for packages storing articles and, more particularly, such resealable closures having a package integrity indicator.

BACKGROUND OF THE INVENTION

Some containers for food products, such as cookies and other snacks, typically include an outer wrapper. In one type of container, the wrapper surrounds a frame which acts as a tray to hold the food product and to protect the food product from damage. Other food products come packaged in plastic trays, such as thermoform trays which are sealed on the top using some type of lidding material. One recent advancement in the art of food container closures includes a resealable closure disclosed in U.S. Pat. No. 6,918,532 (hereinafter "the '532 patent"), herein incorporated by reference, which discloses a wrapper which forms a top of the container, which top has an access opening covered by a resealable sealing panel.

In the packaging art, different structures have been used to indicate whether a package has been previously opened or whether the integrity of the package has been compromised, which structures are often referred to in the art as "tamper-evident." For example, one recent package integrity indicating closure is disclosed in U.S. patent application Ser. No. 11/500,497 hereinafter the '497 application and incorporated by reference, which shows a closure comprising a two-ply material having an inner film layer and an outer film layer forming a top of a container. The outer film layer has a sealing panel covering a portion of the inner film layer which, with the sealing panel, forms an opening. The package integrity feature comprises a panel of the inner film layer which separates from the sealing panel to indicate that the closure has been previously opened.

There is a need for improvement in the art of package integrity indicators for a resealable closure, preferably suitable for use with a resealable closure for containers or packages containing food items.

SUMMARY OF THE INVENTION

The present invention generally relates to a resealable closure for a container in which package integrity is indicated by a structure which breaks and/or produces an audible sound when the resealable closure is opened for a first time.

The present invention, in one form, comprises a package integrity feature having a structure associated with a resealable closure. The structure preferably produces an audible sound when the resealable closure is opened for a first time. In one form, the structure comprises at least one strip initially affixed to a stationary and a movable portion of the resealable closure so that upon opening the resealable closure for a first time, at least one of the strips breaks, preferably producing the audible sound. The strips may include a weakened portion such as a narrowing at one location along its length. Integrity of the package is indicated by an intact strip viewable upon opening the resealable closure and conversely, a broken or non-intact strip would indicate that the resealable closure has been previously opened.

In a further form, package integrity is evidenced by a see-through window in the resealable closure so that a portion is visible therethrough prior to the closure being opened for a first time, but not visible therethrough after the closure has been opened for a first time and resealed. This portion may be one of the strips or it may be a second panel which is separate from the strips.

In another further form, the structure comprises at least two strips, wherein at least one strip will break at a different time than another one or more strips upon opening the resealable closure, thereby preferably producing at least two separate audible sounds as each strip breaks.

The package integrity feature may comprise a closure for a package having a top, an access opening in the top and a sealing panel which covers the access opening and sealingly engages the top around the access opening so as to originally seal the package and then, after having been opened a first time, be resealable against the top. A structure is associated with the resealable closure which preferably produces an audible sound when the resealable closure is opened for a first time. Advantageously, the structure produces an audible sound prior to being able to remove an item contained within the package.

The present invention, in another form, relates to a package integrity indicating closure comprising a film layer forming the top of a container and having a flap defining an access opening to gain access to the contents of the container and having at least one strip joining the flap to a remaining portion of the top. A sealing panel completely covers the flap including the at least one strip of the film layer. A releasable adhesive provided on either or both the sealing panel or on the film layer adheres the sealing panel to the film layer. The sealing panel is releasable from the film layer by pulling the sealing panel back in a peeling direction and is reclosable against the top to seal the access opening when the sealing panel is moved back against the top. Upon peeling the sealing panel back for a first time, the at least one strip joining the flap to the top breaks.

The package integrity indicating closure may also comprise at least a two-ply material comprising an inner layer adhesively joined to an outer layer and, together, forming a top of the container. The inner layer has a first panel, a second panel, and at least one strip joining the first panel to a remaining portion of the top of the container. The outer layer has a sealing panel formed therein which completely covers the first panel, covers the strip and covers the second panel of the inner layer. The first panel and the sealing panel are permanently joined to each other to provide an access opening into the container. A releasable adhesive provided around a perimeter of the sealing panel adheres the sealing panel to the inner layer and the second panel. The sealing panel is releasable from the inner layer and is separable from the second panel by pulling the sealing panel back in a peeling direction and reclosable against the top to seal the opening when the sealing panel is moved back against the top. Upon opening the closure for a first time, the at least one strip between the first panel and the remaining portion of the top of the container breaks. After closing, the second panel is separated from the sealing panel. Advantageously, in one form, the at least one strip is integrally formed with the inner layer.

Package integrity may also be indicated by misalignment of sealing panel holes with tab portions after the sealing panel has been opened and resealed.

Food items disposed in the container may include but are not limited to cookies, crackers, peanuts, cheese, sliced meats, and semi-solid foods.

Other features and advantages of the present invention are stated in or apparent from detailed descriptions of the presently preferred embodiments of the invention found herebelow.

DETAILED DESCRIPTION

Figure 1:
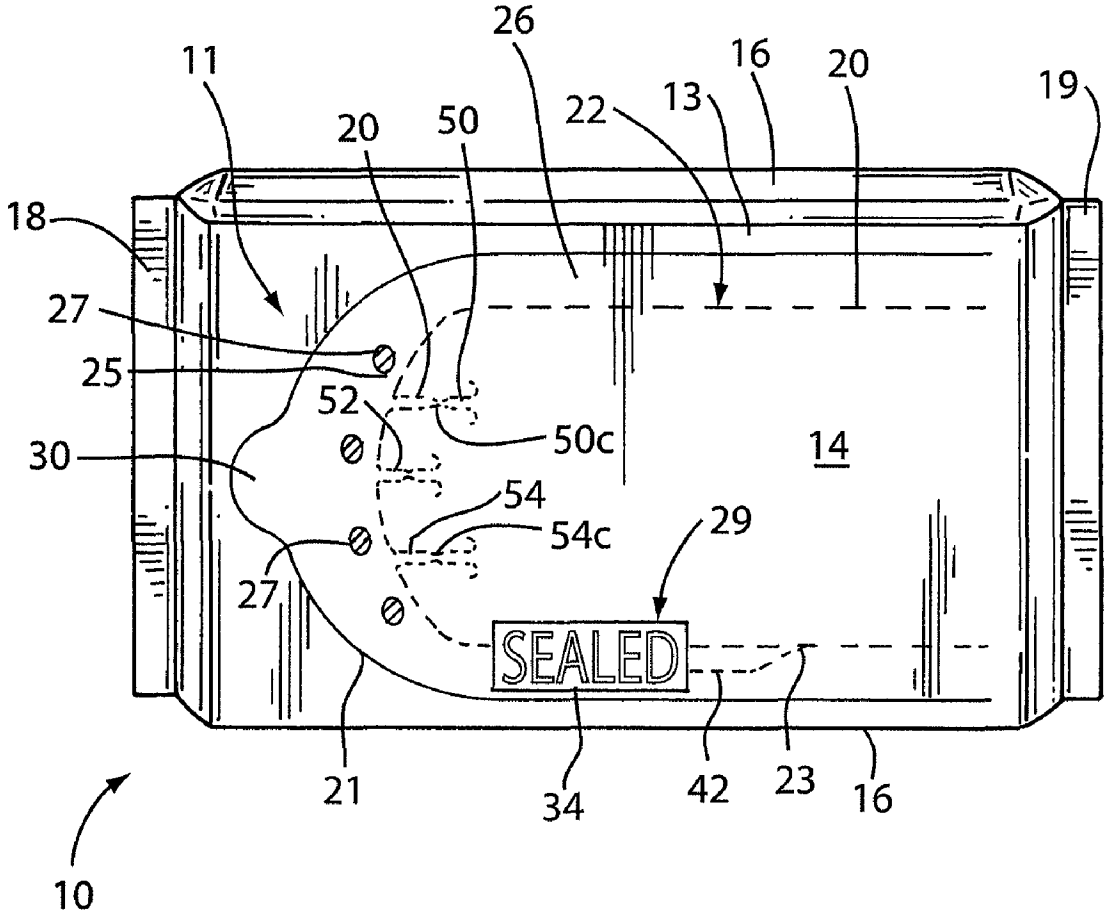
FIG. 1 is a perspective view of a package including an exemplary closure prior to an initial opening, according to the present invention.

Referring to the figures and, in particular, FIGS. 1-4, there is shown package 10 with closure 11, which incorporates a package integrity feature. Package 10 includes a two-ply wrapper comprising a first, inner film layer 12 and a second, outer film layer 13, forming a top or upper surface 14, sides 16, lower surface (not shown), and crimped ends 18, 19. The inner film layer 12 and outer film layer 13 are formed from a polymeric film or other flexible material that has been cut, folded or otherwise pressed to define an inner space or receptacle for receiving the desired product, such as food items, to be provided within the package 10. Package 10 can be used to store and distribute food items such as cookies, crackers, candy or other items. The outer film layer 13 may include graphics or other indicia to identify the contents of the package 10.

Advantageously, the inner film layer 12 is coextensively formed and adhesively joined to the outer film layer 13. During the manufacturing of the package 10, the first, inner film layer 12 is die cut on its side via first tear line 20, which includes all of the dashed lines in FIG. 1, other than second tear line 23. Outer film layer 13 is die cut on its side via a third tear line 21 and die cuts 25. Inner and outer tear lines are disclosed in U.S. Patent Application Publication No. 2005/0276525, herein incorporated by reference.

The first tear line 20 is formed as a continuous tear line to define a first panel 22. The first tear line 20 also defines a plurality of strips 50, 52, 54. A second tear line 23 forms a second panel 42 which also serves to indicate package integrity.

Figure 2A:
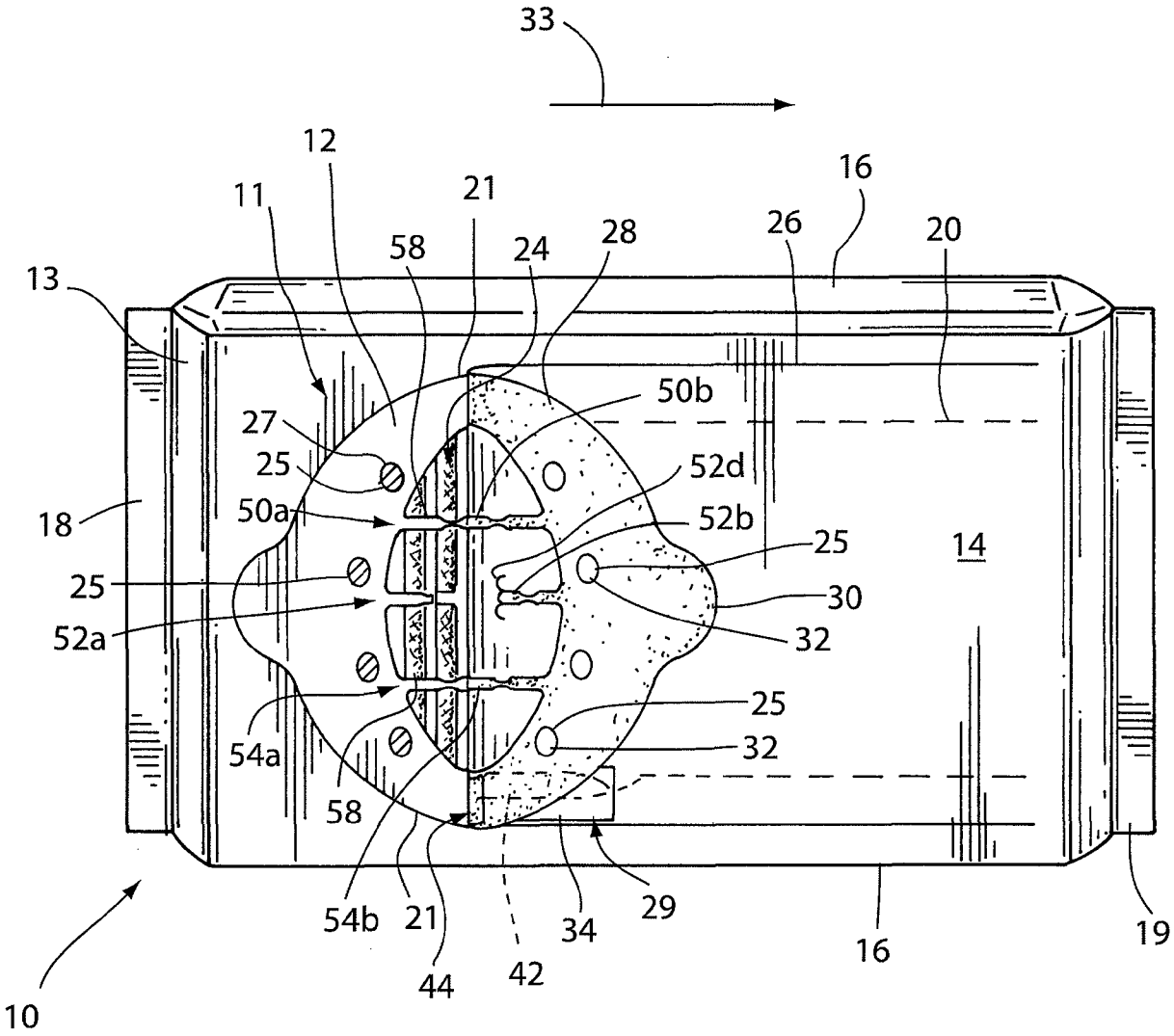
FIG. 2*a* is the package of FIG. 1, shown in a first partially opened condition.
Figure 2B:
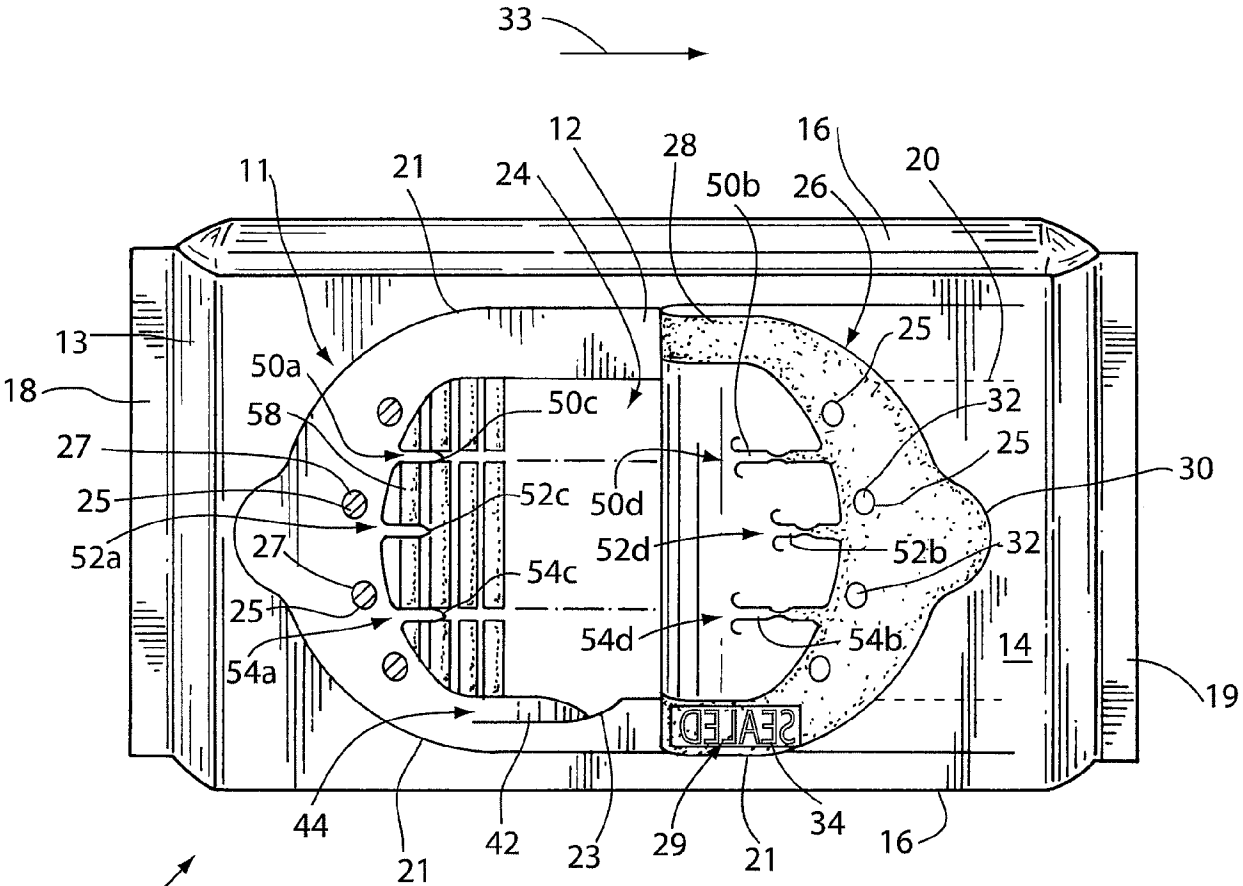
FIG. 2*b* is the package of FIG. 1, shown in a further partially opened condition relative to that of FIG. 2*a;*

The first panel 22 can be separated from the remainder of the inner film 12 to expose an opening 24 whereby access to the contents of the package may be gained after the strips 50, 52, 54 have broken (FIG. 2*a*, 2*b*). Each strip 50, 52, 54 is integrally joined, and remains attached to the remaining portion of the inner layer 12 which comprises the top 14 at strip portions 50*a*, 52*a*, 54*a*, respectively, and a portion of the strips 50, 52, 54 remains integrally attached to the first panel 22 at strip portions 50*b*, 52*b*, 54*b*, respectively. Each strip 50, 52, 54 has a weakened portion defined by a narrowing in the width of the strip at portions 50*c*, 52*c*, 54*c*, respectively. The narrowing portions 50*c*, 52*c*, 54*c* provide an area of weakness to the respective strip 50, 52, 54 whereby the respective strip breaks at the narrowing portions 50*c*, 52*c*, 54*c* upon opening the closure 11 for a first time.

Strip portions 50*b*, 52*b*, 54*b* are integrally joined to the first film layer flap 22 at strip ends 50*d*, 52*d*, 54*d*, respectively. Advantageously, die cut 20 forms the strip ends 50*d*, 52*d*, 54*d* in the shape of parallel "U"'s which help ensure that the strips 50, 52, 54 will not tear at strip ends 50*d*, 52*d*, 54*d* and will remain integrally joined to the first panel 22 and allow the strips 50, 52, 54 to break at the weakened narrowing strip portions 50*c*, 52*c*, 54*c*, respectively.

The second panel 42 remains integrally joined to the inner film layer 12 at end 44, even after the package is opened, and the remainder of the second panel 42 falls down into the opening 24 as described in more detail in the '497 application.

The third tear line 21 defines sealing panel 26 of the outer film layer 13 and the die cuts 25 define a plurality of tab portions 27 in the sealing panel 26. The sealing panel 26 extends beyond the periphery of the first tear line 20 and the second tear line 23 adjacent to the opening 24, so that the sealing panel 26 completely covers and extends beyond the perimeters of the first panel 22, strips 50, 52, 54, and the second panel 42. As a result, sealing panel 26 completely covers the first panel 22, the strips 50, 52, 54, and the second panel 42.

The side of the sealing panel 26 which faces the inner film layer 12, including tab portions 27, is coated with a releasable adhesive 28 (see FIGS. 2*a*, 2*b*) so that the sealing panel 26 may be resealably secured to the inner film layer 12 at a portion adjacent the first panel 22, and so that the tab portions 27 remain permanently affixed to the inner film layer 12.

Alternatively or along with releasable adhesive 28, releasable adhesive can be coated on the inner film layer 12 along the outside perimeter of the first panel 22. The releasable adhesive can be any pressure sensitive adhesive which allows resealing and includes, but is not limited to, the adhesives disclosed in U.S. patent application Ser. No. 11/029,626, herein incorporated by reference. The sealing panel 26 is provided with a tab 30 or other gripping feature which is not coated with adhesive 28 so that the sealing panel 26 may be peeled back from the inner film layer 12 to open the package 10.

Advantageously, the sealing panel 26 has a see-through window portion 29 which lies over the second panel 42 of the inner film layer 12 prior to the package 10 being opened for a first time which permits one to visually observe the second panel 42 adhered thereto prior to the package 10 being opened for a first time and to observe the absence of the second panel 42 attached to the sealing panel 26 after the package 10 has been opened to indicate package integrity as described in the '497 application.

Figure 3:
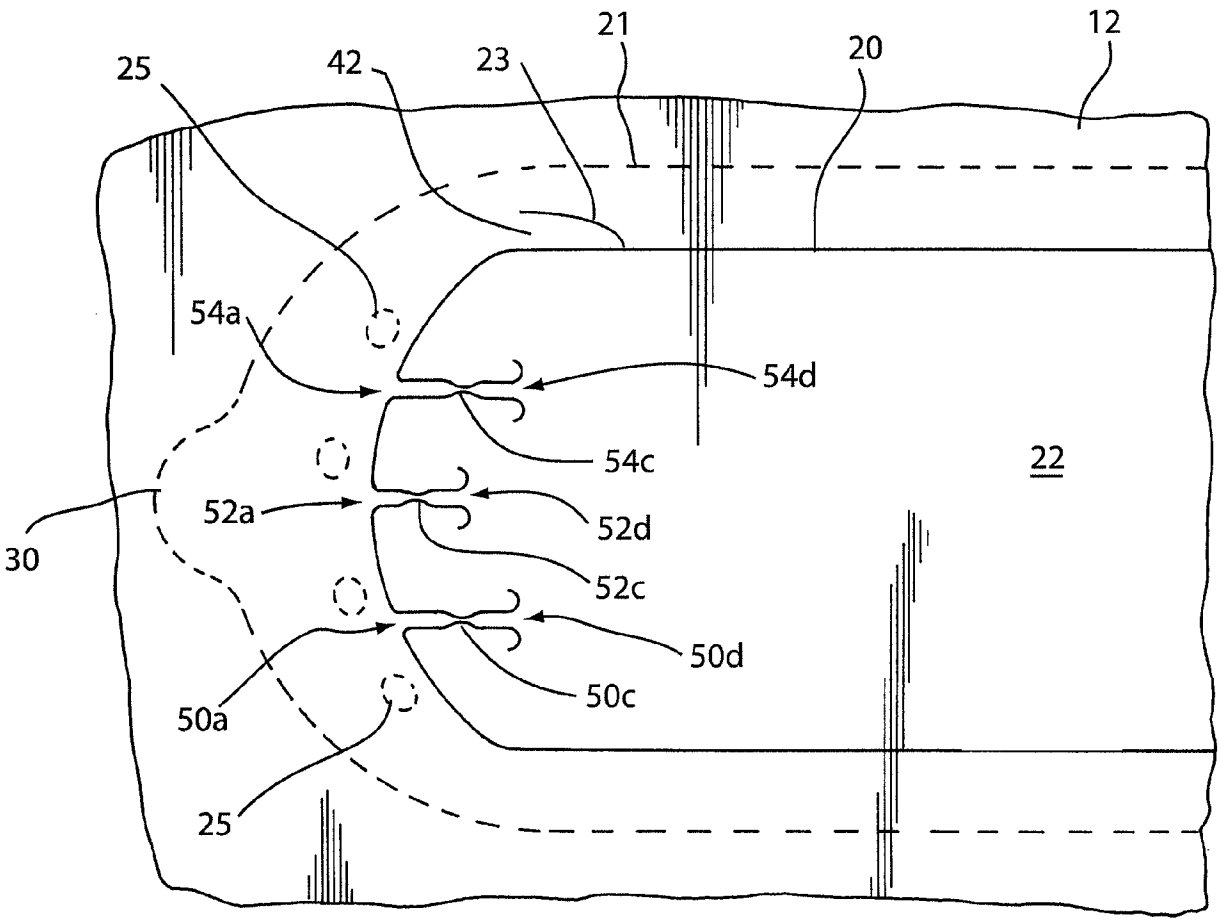
FIG. 3 is a partial plan view of the closure of FIG. 1, as viewed from below in its initial condition prior to being opened for a first time according to the present invention.

Referring now specifically to FIGS. 2*a*, 2*b* and FIG. 3, package 10 is opened by grasping tab 30 and peeling the sealing panel 26 back in the peeling direction as indicated by arrow 33 (FIGS. 2*a*, 2*b*). As the sealing panel 26 is peeled back for a first time, the first panel 22 is separated from the remainder of the inner film layer 12, including the second panel 42 and a portion of the strips 50, 52, 54, along the first film layer tear line 20. Strip portions 50*a*, 52*a*, 54*a* remain integrally attached to the remaining portion of the inner film layer 12, and strip portions 50*b*, 52*b*, 54*b* remain integrally attached to the first panel 22 (FIG. 3). In addition, tab portions 27 separate from sealing panel 26 and remain attached to the inner film layer 12 due to adhesive 28, to thereby form holes 32 in the sealing panel 26 (FIGS. 2 and 3).

Initially, upon opening the closure 11, the strip portions 50*a*, 52*a*, 54*a* separate from the sealing panel 26 while strip portions 50*b*, 52*b*, 54*b* remain attached to the sealing panel 26 as shown in FIG. 2*a*. At some point upon peeling the sealing panel 26 back, strip 52 preferably first breaks at narrowing strip portion 52*c* while strips 50 and 54 remain intact (FIG. 2*a*). When strip 52 breaks, an audible sound, such as a snap is produced. As shown in FIGS. 2*a* and 2*b*, the strips may be spaced apart a distance less than the largest dimension of the contents, shown for example in FIGS. 2*a* and 2*b* as a cookie 58, so that in practice before strip 52 has been broken, the spacing between the strip is too small for removal of a cookie 58.

Pulling the sealing panel 26 further in direction of arrow 33 further opens the closure 11 and eventually strips 50 and 54 break at narrowing strip portion 50*c*, 54*c*, respectively. As each strip breaks an audible sound such as a snap occurs. Advantageously, the strip narrowing portion 50*c*, 54*c* are at the respective same position along the strip 50, 54 so that the strips 50 and 54 break at the same time, thereby producing a unified or single audible sound. Since strip 52 breaks prior to strips 50, 54, two audible sounds are produced, one upon strip 52 breaking, and a second one as strips 50 and 54 break simultaneously.

Package integrity is indicated by closure 11 through several novel features incorporated into the closure 11. Package integrity is indicated visually by one observing the intact integrally joined strips 50, 52, 54 which advantageously break upon opening the closure 11 a sufficient amount prior to allowing one to remove contents therein thereby indicating package integrity. Further, package integrity is indicated by audible sounds produced when the strips break, whereby the audible sound indicates that the package is being opened for a first time.

In addition, package integrity is indicated by the visual indication of a portion 34 of the sealing panel 26, shown as black outlined letters for the word "SEALED," and a portion 36 of the inner film layer 12 spanning a portion of the panel 22, shown as being gray, which is viewable through the window portion 29 prior to the closure 11 being opened for a first time (FIG. 1), and a middle portion of the word "SEALED" having a void 46 which void exists because the second panel 42, which was present and intact before the package was opened the first time, has now fallen down in the package and is not visible in the void area 46. The void area 46 is thus shown as not shaded after the closure has been opened and resealed (FIG. 4).

Figure 4:
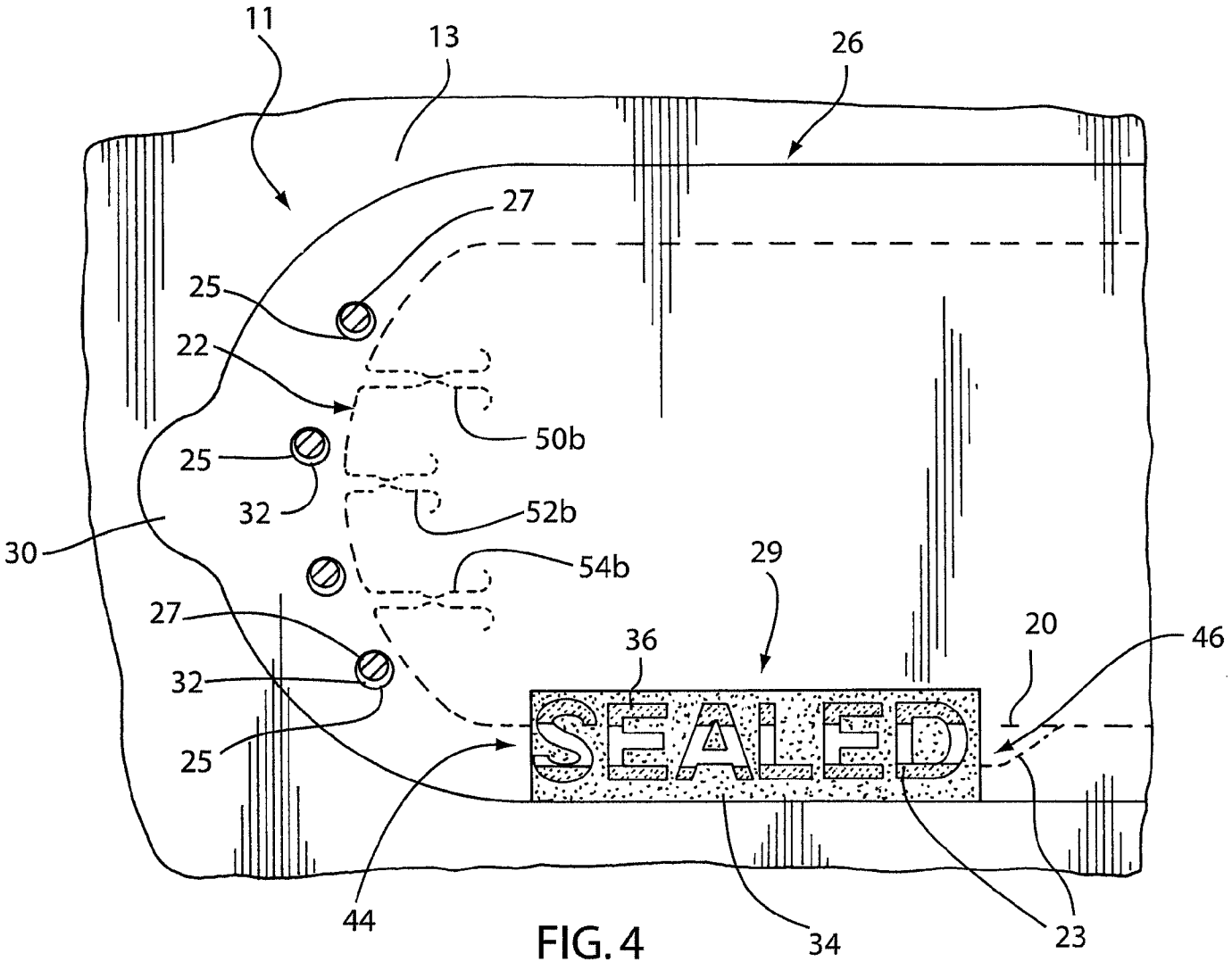
FIG. 4 is a partial plan view of the closure of FIG. 1, after an initial opening and reseal, according to the present invention.

Further, since the sealing panel 26 does not generally return to its exact original position, but instead is slightly misaligned relative to its original position, package integrity is indicated by such misalignment of the sealing panel holes 32 with the tab portions 25 after the sealing panel 26 has been opened and resealed (FIG. 4).

Figure 5:
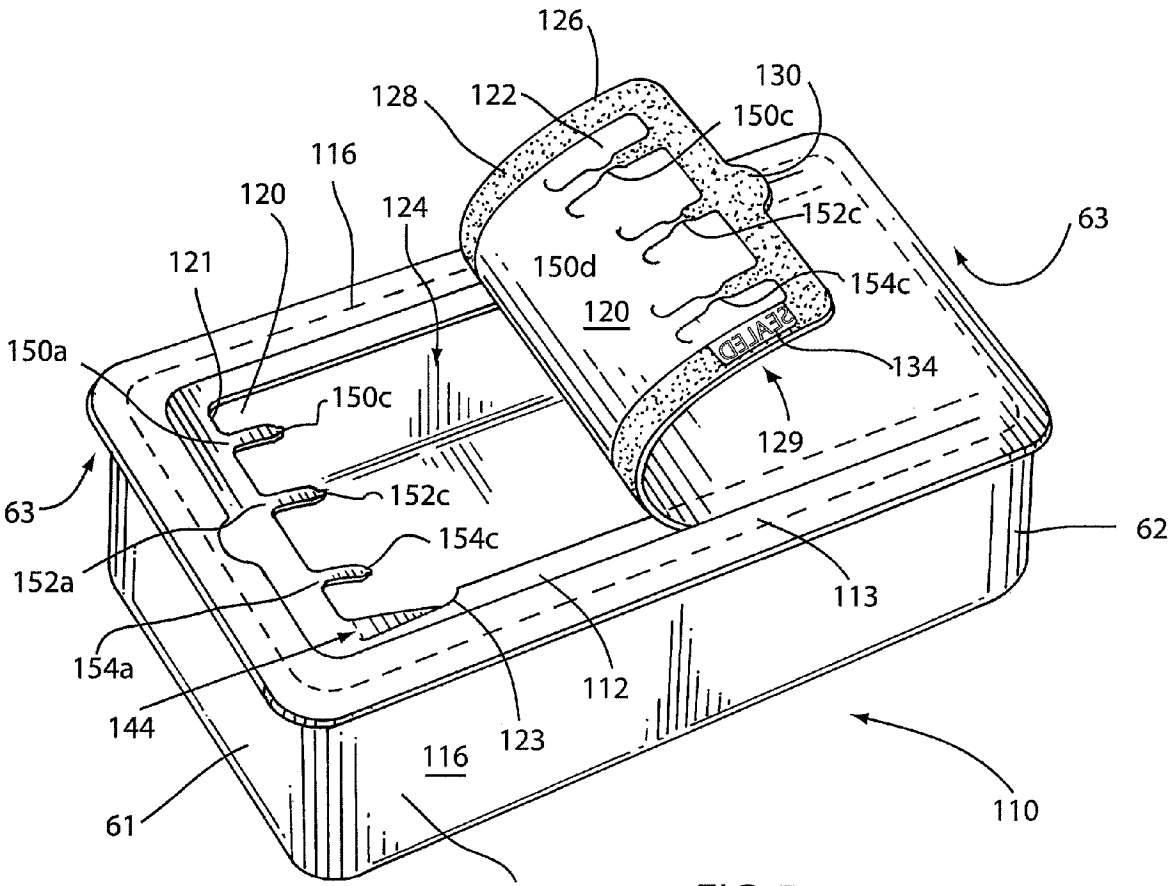
FIG. 5 is a perspective view of another package, including a closure that has been opened, in accordance with the present invention.

Referring to FIG. 5, like elements to those of the embodiment of FIGS. 1-4 are increased by 100. Package 110 comprises a thermal formed tray 60 which forms the sides 116 and ends 61, 62. A two-ply film material comprising an inner film layer 112 and a outer film layer 113 are sealed to flange 63 of the thermal formed tray 60. Like package 10, pulling back on tab 130 separates the sealing panel 126 from the outer film layer 113 and separates the first panel 122 from the inner film layer 112, portions of the strips 150, 152, 154 and the second panel 142. After package 110 has been opened for a first time, the strips 150, 152, 154 will break at narrowing strip portions 150*c*, 152*c*, 154*c* producing an audible sound upon breaking and providing a visual indication of package integrity status that the package has been previously opened as shown in FIG. 5.

Package 110 can be used for various food items, such as cheese, sliced meats and the like. In addition, package 110 can be used for semi-solid items, such as pudding and yogurt. Although package 110 is depicted as having a rectangular shape, the package 110 can have any shape, including cylindrical and irregular.

The inner and outer film layers 112, 113 may be formed of the same material as layers 12, 13, which includes polypropylene, polyethylene, cellophane or any other polymeric material suitable for forming a package enclosure.

Figure 6:
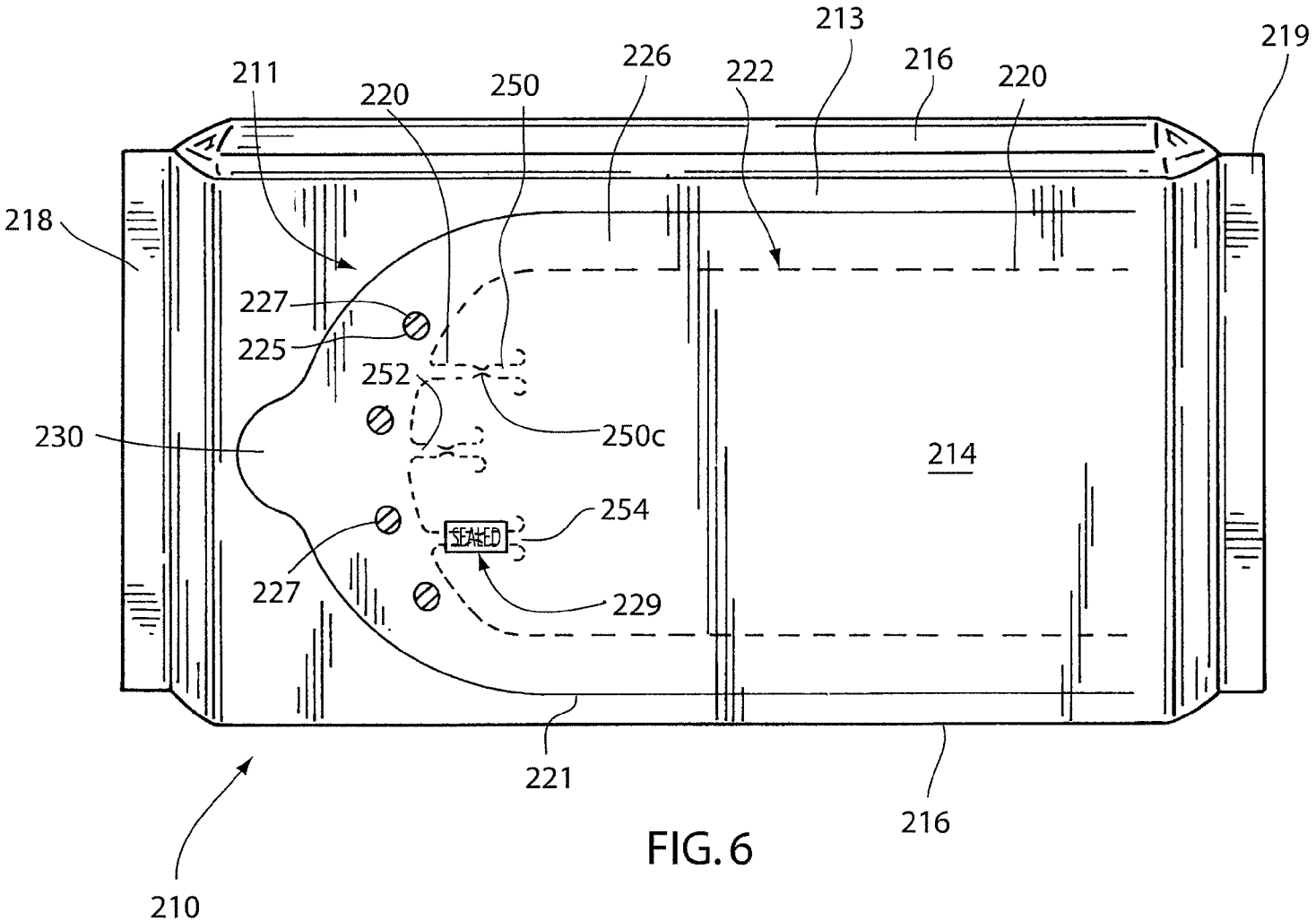
FIG. 6 is a perspective view of another package, including another closure prior to an initial opening, according to the present invention.
Figure 7:
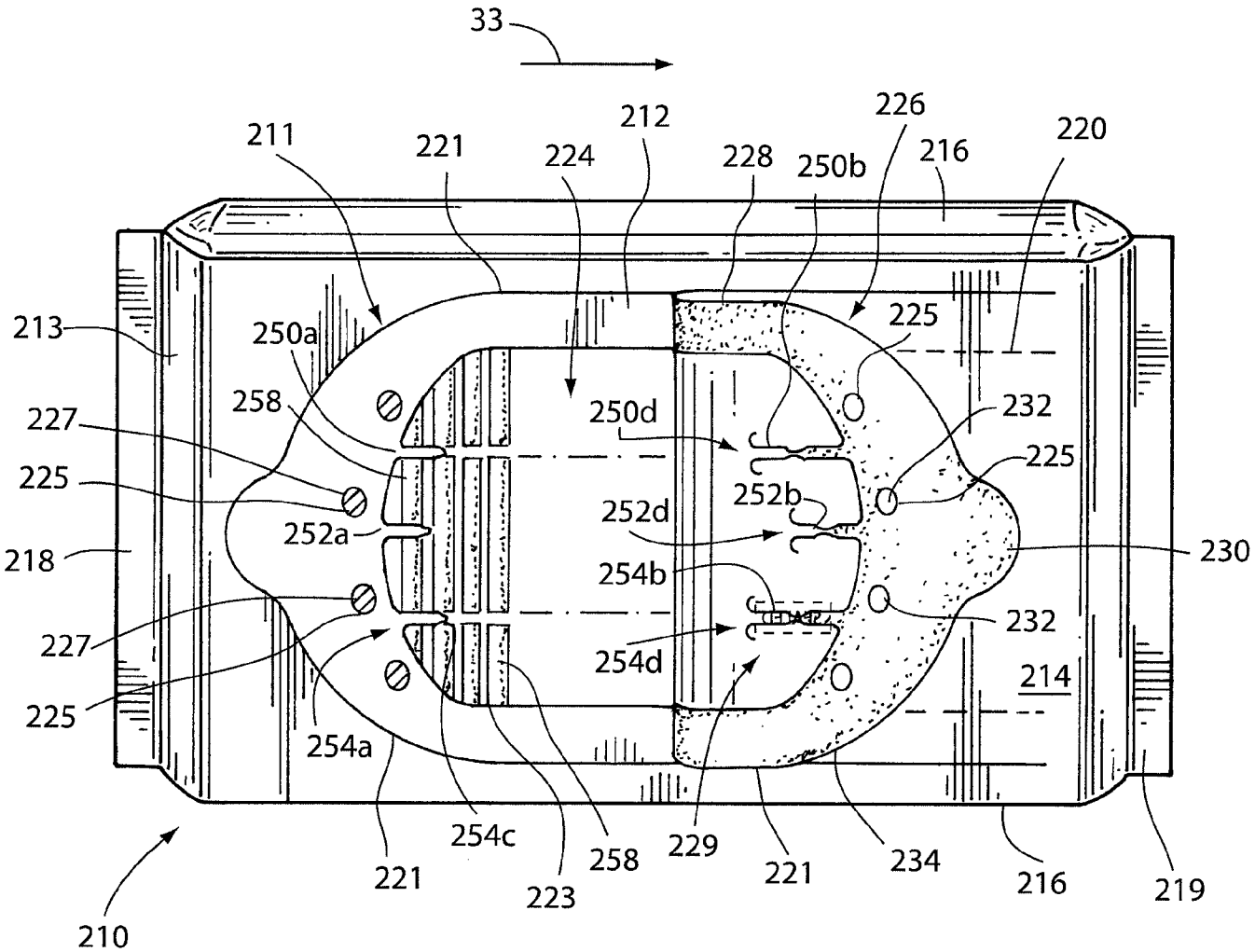
FIG. 7 is the package of FIG. 6, shown in a partially opened condition.
Figure 8:
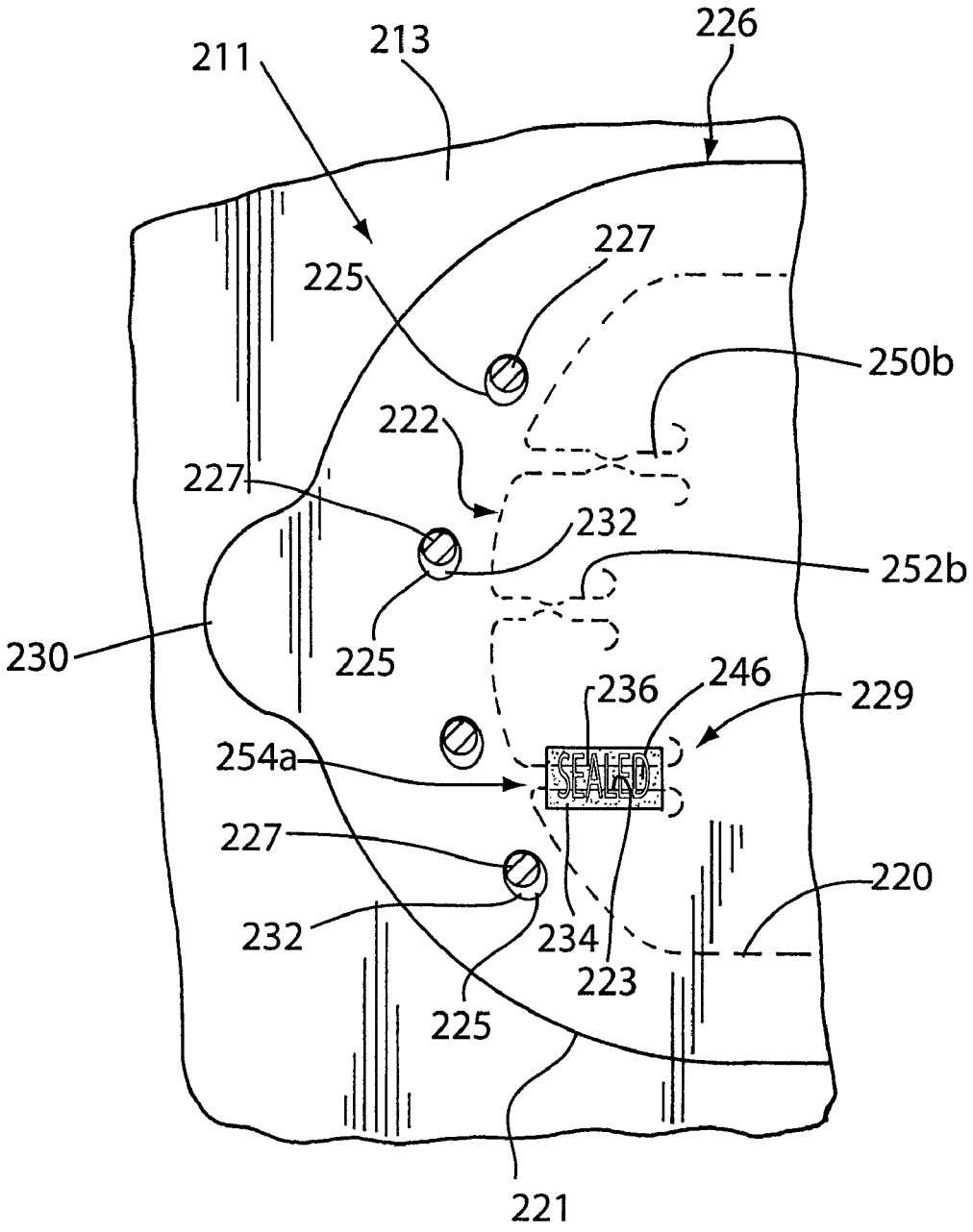
FIG. 8 is a partial plan view of the closure of FIG. 6, after an initial opening and reseal, according to the present invention.

Referring now to FIGS. 6-8, like elements of the embodiment of FIGS. 1-4 are increased by 200. The sealing panel 226 has a see-through window portion 229 which lies over strip 254 of the inner film layer 212 prior to the package 210 being opened for a first time, which permits one to visually observe the strip 254 adhered thereto prior to the package 210 being opened for a first time. Like package 10, pulling back on tab 230 separates the sealing panel 226 from the outer film layer 213 and separates the first panel 222 from the inner film layer 22 and portions of strips 250, 252 and 254. After package 210 has been opened for a first time, the strips 250, 252, 254 will break at narrowing strip portions 250*c*, 252*c*, 254*c*, producing an audible sound upon breaking, and providing a visual indication of package integrity status that the package has been previously opened, as shown in FIG. 7. In addition, package integrity status is evidenced by the absence of portions of the strip 254 being attached to the sealing panel 226 after the package 210 has been opened.

Figure 9:
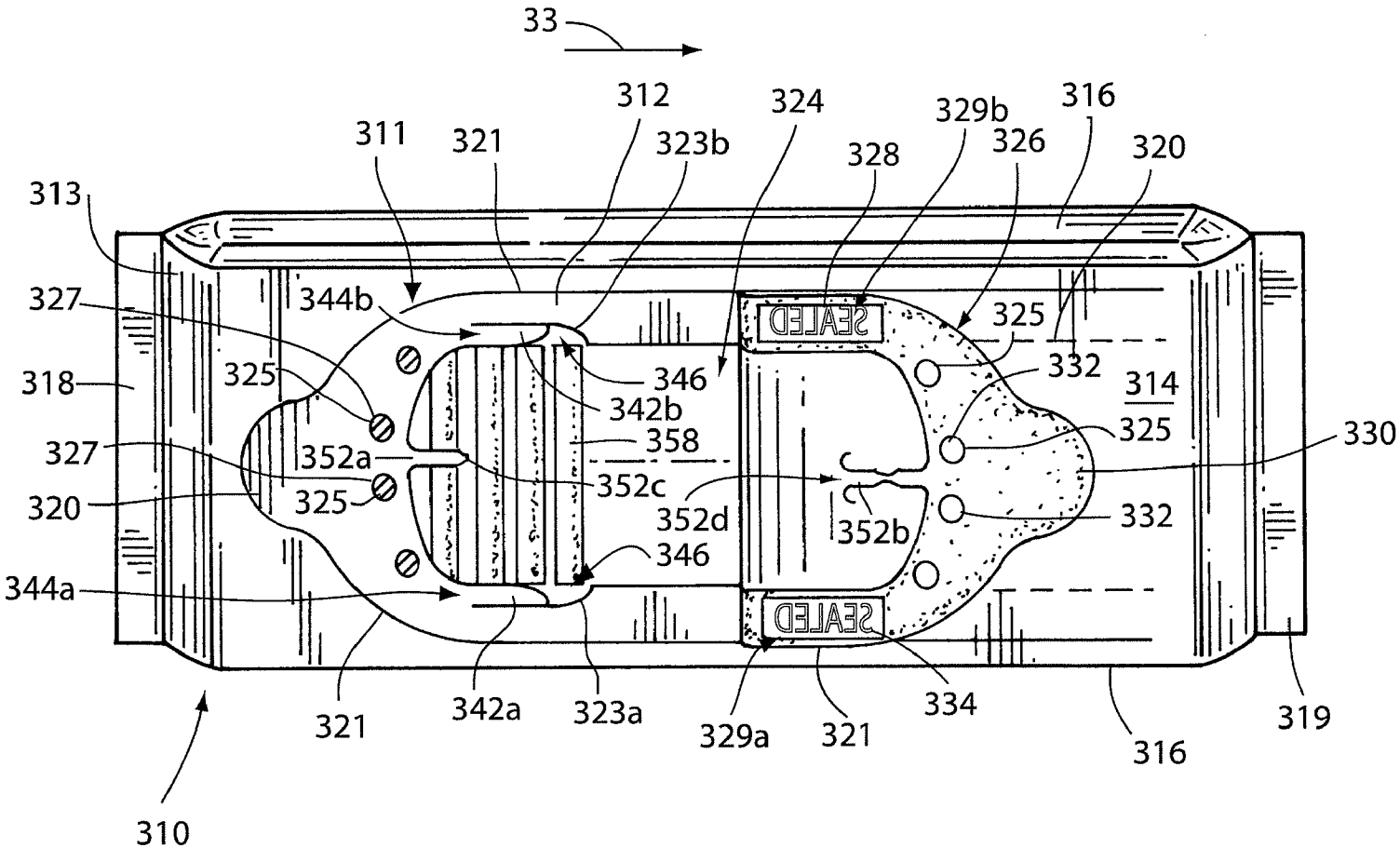
FIG. 9 is a perspective view of another package, including another closure, shown in a partially opened condition.
Figure 10:
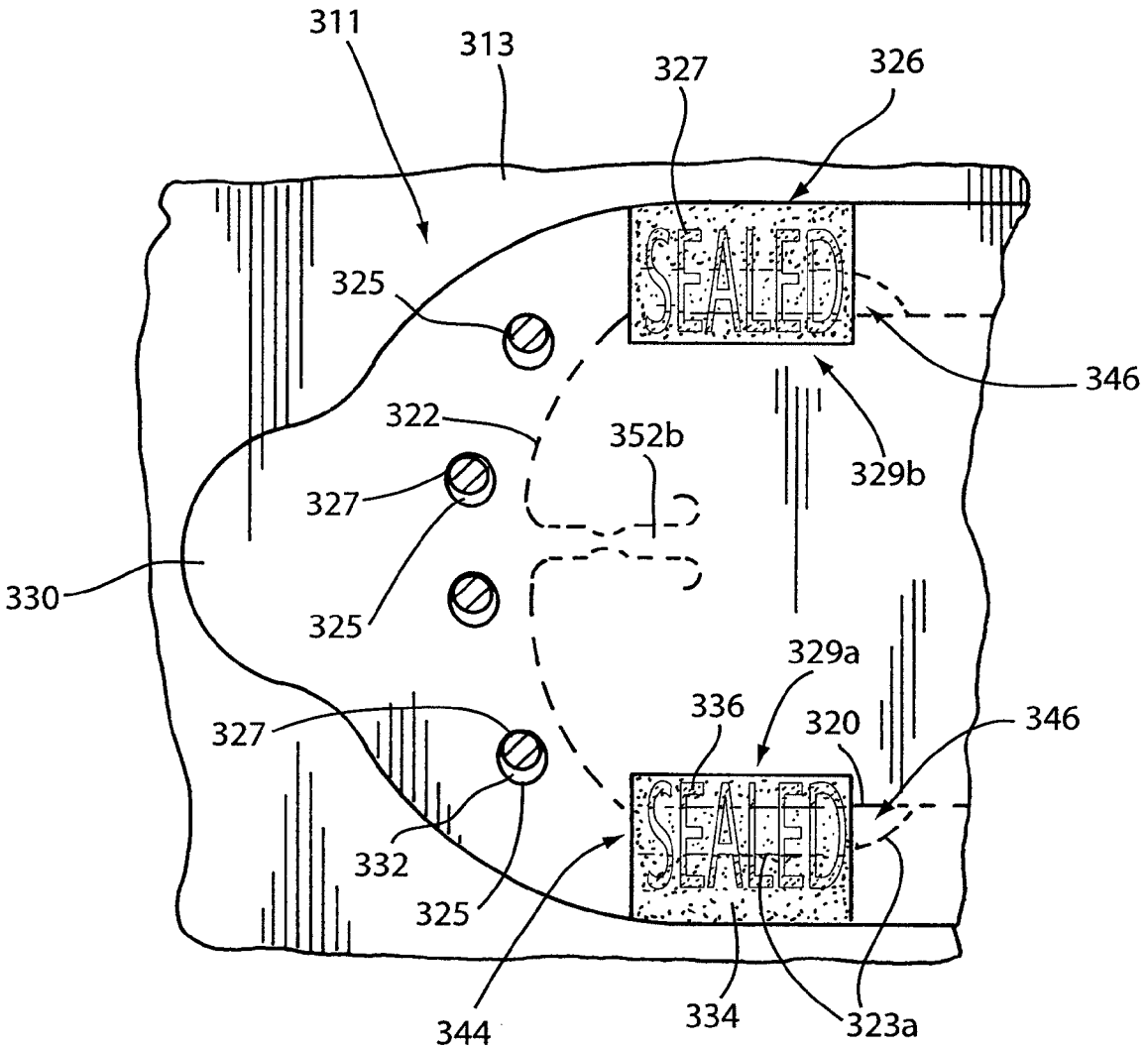
FIG. 10 is a partial plan view of the closure of FIG. 9, after an initial opening and reseal, according to the present invention.

Referring now specifically to FIG. 8, package integrity status is also indicated by the visual indication of a portion 234 of the sealing panel 226, shown as black outline letters for the word "SEALED," prior to the closure 211 being opened for a first time (FIG. 6), and a middle portion of the word "SEALED," having a void 246 which void exists because the strip 254 which was present and intact before the package was opened the first time has now fallen down into the package and is not visible at void 246. This void 246 is thus shown as not shaded after the closure has been opened and resealed (FIG. 8). In addition, like package 10, package integrity status is indicated by a slight misalignment of the sealing panel holes 232 with the tab portions 225 after the sealing panel 226 has been opened and resealed (FIG. 8) in a similar manner as package 10. Referring now to FIGS. 9 and 10, in accordance with another embodiment, package 310 has a single strip 352 located at a mid-portion of the opening 324. Package 310 is designed to accommodate a single row of food items, such as cookies 358.

Referring now to FIGS. 9 and 10, in accordance with another embodiment, package 310 has a single strip 352 located at a mid-portion of the opening 324. Package 310 is designed to accommodate a single row of food items, such as cookies 358.

Tear lines 323*a* and 323*b* form a pair of integrity indicating panels 342*a*, 342*b*, respectively. When the package 310 is opened for a first time, the panels 342*a*, 342*b* remain integrally joined to the inner film layer 312 at end 344*a*, 344*b*, even after the package 310 is opened, and the remainder of the panels 342*a*, 342*b* fall down into the opening 324, as described in more detail in the '497 application.

Package 310 includes a sealing panel 326 with a pair of see-through window portions 329*a*, 329*b* which lie over panels 342*a*, 342*b*, respectively, of the inner film layer 312 prior to the package 310 being opened for a first time. The see-through windows 329*a*, 329*b* permit one to visually observe the panels 342*a*, 342*b* adhered thereto prior to the package 310 being opened for a first time and to observe the absence of the sealing panels 342*a*, 342*b* attached to the sealing panel 326 after the package 310 has been opened to indicate package integrity status.

Once package 310 has been opened and resealed, package integrity status is evidenced by the absence of the panels 342*a*, 342*b* attached to the sealing panel 326 in a similar manner as indicated for second panel 42 in package 10. In addition, like package 10, the integrity of package 310 is observable by a misalignment of the sealing panel holes 332 with the tab portion 325 after the sealing panel 326 has been opened and resealed (FIG. 11). Further package integrity status is provided by an audible sound as strip 352 breaks when package 310 is opened for a first time.

The present invention specifically shows embodiments with three rows of food products (such as cookies) with three strips and with a single row of food products (such as cookies) and a single strip. It is to be understood that the invention is applicable to packages with any number of rows of food products, wherein the number of strips will be selected as desired, considering the number of rows of food products, the width of the package and the desired spacing of the strips. Also, different sized packages can employ any desired number of windows, whether such windows lie over second or third panels or over one or more strips. In addition, the food products can be arranged in rows across the package, or the food product may involve no rows at all, such as for peanuts. In any of these arrangements, the present invention can include any suitable number of strips and/or any suitable number of sealed windows.

As will be apparent to one of ordinary skill in the art that the present package integrity feature of the present closure offers benefits over prior tamper-evident or package integrity features.

The invention claimed is:

1. A package integrity feature comprising:

a structure associated with a resealable closure and a corresponding container, said structure producing an audible sound when the resealable closure is opened for a first time, the structure including at least two strips formed of a top of the corresponding container initially affixed to the resealable closure and the corresponding container and, upon opening the resealable closure for the first time, each of the at least two strips breaks into a plurality of portions, thereby producing the audible sound; and wherein each of the two strips has a weakened portion where the strip breaks and the weakened portions are disposed at two different locations from an end of the container, wherein the two strips break at different times upon initial opening of the resealable closure to thereby produce two separate audible sounds upon initial opening of the resealable closure.

2. The package integrity feature of claim 1, comprising three strips, wherein two of the strips have the weakened portion at a same location from the end of the container and break at the same time upon initial opening of the resealable closure.

3. The package integrity feature of claim 1, further comprising a see-through window portion lying over at least one of the two strips prior to the resealable closure being opened for a first time.

4. The package integrity feature of claim 1, wherein the weakened portion is in the form of a narrowing of a portion of the strip.

5. The package integrity feature of claim 1, wherein an intact strip provides indicia that the resealable closure has not been opened and a separated strip provides indicia that the resealable closure has been previously opened.

6. The package integrity feature of claim 1 wherein the plurality of portions of the two strips comprise first and second ends, the first end being integrally joined to the resealable closure and the second end being integrally joined to the container.

7. The package integrity feature of claim 6 wherein the container comprises a film wrapper and the first end of each of the two strips is integrally joined to a panel that is formed in and is separable from an inner film layer of the film wrapper and the second end is integrally joined to a remaining portion of the inner film layer of the film wrapper.

8. A package having a package integrity closure comprising:

a top, a flap formed in the top, when the flap is disengaged from a remainder of the top an access opening is exposed in the top;

a sealing panel, which covers the flap and the access opening, sealingly engages the top around the access opening so as to originally seal the package and then, after having been opened a first time, be resealable against the top; and at least one strip formed in the top having portions extending from the remainder of the top and the flap, and upon initial opening of the package, the at least one strip breaks such that the portions affixed to the remainder of the top and the flap respectively are separated, thereby providing an audible sound indication that the package has been opened;

wherein the sealing panel comprises at least one tab portion which separates from the sealing panel upon opening for a first time, and remains affixed to the top, to thereby form a hole in the sealing panel, such that, upon resealing the sealing panel with the top, the hole is misaligned with the tab portion and provides a visual indication that the package has been previously opened.

9. The package of claim 8, wherein the at least one strip produces an audible sound prior to being able to remove an item contained therein.

10. The package of claim 8, further comprising a plurality of strips affixed to both the remainder of the top and the flap, wherein spacing between the strips, prior to breaking of any of them, is small enough such that items in the container cannot be removed from the container between the strips without breaking at least one of the plurality of strips.

11. The package of claim 8, wherein the strip comprises a weakened portion, whereby the strip breaks prior to opening the package significantly enough to be able to remove an item contained therein.

12. The package of claim 8, wherein said sealing panel comprises a see-through window portion lying over the at least one strip prior to the resealable closure being opened for a first time.

13. A package having a package integrity closure comprising:

a top, a flap formed in the top, when the flap is disengaged from a remainder of the top an access opening is exposed in the top;

a sealing panel, which covers the flap and the access opening, sealingly engages the top around the access opening so as to originally seal the package and then, after having been opened a first time, be resealable against the top; and at least two strips formed in the top having portions extending from the remainder of the top and the flap, and upon initial opening of the package, each of the at least two strips breaks such that the portions affixed to the remainder of the top and the flap respectively are separated, thereby providing an audible sound indication that the package ahs been opened;

wherein each of the two strips has a weakened portion where the strip breaks weakened portions are disposed in two different locations from an end of the container such that the two strips break at different times upon opening the resealable closure to thereby produce two separate audible sounds upon opening the resealable closure.

14. The package of claim 13, further comprising three strips, wherein spacing between the strips, prior to breaking of any of them, is small enough such that items in the container cannot be removed from the container between the strips without breaking at least one of the plurality of strips.

15. The package of claim 13, wherein the strip comprises a weakened portion, whereby the strip breaks prior to opening the package significantly enough to be able to remove an item contained therein.

16. The package of claim 13, wherein said sealing panel comprises a see-through window portion lying over one of the two strips prior to the resealable closure being opened for a first time.

17. A package integrity indicating closure, the closure comprising:

a film layer forming a top of a container and having a flap defining an access opening to gain access to the contents of the container, and having at least one strip formed of a top of the container joining the flap to a remaining portion of the top;

a sealing panel completely covering the flap of the film layer; and releasable adhesive provided on either or both the sealing panel or on the film layer for adhering the sealing panel to the film layer, the sealing panel being releasable from the film layer by pulling the sealing panel back in a peeling direction and reclosable against the top to seal the access opening when the sealing panel is moved back against the top, wherein upon peeling the sealing panel back for a first time, the at least one strip joining the flap to the remaining portion of the top breaks into a plurality of portions.

18. The package integrity indicating closure of claim 17, wherein the at least one strip comprises a weakened portion.

19. The package integrity indicating closure of claim 17, wherein the flap and at least one strip is integrally formed with the film layer.

20. The package integrity indicating closure of claim 19, wherein the flap and at least one strip are die cut from the film layer.

21. The package of claim 17, wherein the sealing panel comprises at least one tab portion which separates from the sealing panel upon opening the resealable closure for a first time, and remains affixed to the top, to thereby form a hole in the sealing panel, such that, upon resealing the sealing panel with the top, the hole is misaligned with the tab portion.

22. The package of claim 17, wherein said scaling panel comprises a see-through window portion lying over the at least one strip prior to the resealable closure being opened for a first time.

23. The package of claim 17 wherein the plurality of portions of the at least one strip comprise first and second ends, the first end being integrally joined to the top of the container and the second end being integrally joined to the flap.

24. An integrity indicating closure for a container comprising:

an at least two-ply material comprising an inner layer adhesively joined to an outer layer and forming a top of the container;

said inner layer having a first panel, a second panel, and at least two strips joining the first panel to a remaining portion of the top of the container, said outer layer having a sealing panel formed therein which completely covers the first panel and covers the two strips and the second panel of the inner layer, said first panel and said sealing panel being permanently joined to each other to provide an access opening into the container; and a releasable adhesive provided around a perimeter of said sealing panel for adhering said sealing panel to said inner layer and said second panel, said sealing panel being releasable from said inner layer and separable from the second panel by pulling the sealing panel back in a peeling direction and reclosable against said top to seal said opening when said sealing panel is moved back against said top;

each of the two strips between the first panel and the remaining portion of the top of the container have a weakened portion where the strip breaks upon initial opening and the weakened portions are disposed in two different locations from an end of the container;

wherein upon opening the closure for a first time, the two strips break at different times to produce two separate audible sounds upon initial opening; and whereby after closing, the second panel is separated from the sealing panel.

25. The integrity indicating closure of claim 24, wherein said at least one strip is integrally formed with said inner layer.

26. The integrity indicating closure of claim 24, wherein said second panel is constructed to fall into said container when said sealing panel is peeled back for a first time.

27. The integrity indicating closure of claim 24, wherein the inner layer further comprises a third panel and the outer layer completely covers the third panel, whereby upon opening the closure for a first time, the third panel separates from the sealing panel.

28. The integrity indicating closure of claim 27, wherein said sealing panel comprises a see-through window portion lying over said second panel and said third panel of said inner layer prior to said closure being opened for a first time.

29. The integrity indicating closure of claim 24, wherein said sealing panel comprises a see through window portion lying over said second panel of said inner layer, prior to said closure being opened for a first time.

30. The integrity indicating closure of claim 24, wherein said second panel falls away from the plane of said opening, after the sealing panel is peeled back from said inner layer for a first time.

31. The integrity indicating closure of claim 24, further comprising food items disposed in the container, said food items selected from the group consisting of cookies, crackers, peanuts, cheese, sliced meats, and semi-solid foods.

32. The integrity indicating closure of claim 24, wherein the sealing panel comprises at least one tab portion which separates from the sealing panel upon opening the closure for a first time, and remains affixed to the top, to thereby form a hole in the sealing panel, such that, upon resealing the sealing panel with the top, the hole is misaligned with the tab portion.

* * * * *

UNITED STATES PATENT AND TRADEMARK OFFICE

CERTIFICATE OF CORRECTION

PATENT NO. : 8,408,792 B2
APPLICATION NO. : 11/693751
DATED : April 2, 2013
INVENTOR(S) : Carole A. Cole et al.

It is certified that error appears in the above-identified patent and that said Letters Patent is hereby corrected as shown below:

In the Claims

In Claim 13, Column 9, Line 16, after the word package, delete “ahs” and insert --has--, therefor.

In Claim 13, Column 9, Line 18, after the word breaks, insert --and the--.

In Claim 22, Column 10, Line 3, after the word said, delete “scaling” and insert --sealing--, therefor.

Signed and Sealed this
Ninth Day of July, 2013

Teresa Stanek Rea
*Acting Director of the United States Patent and Trademark Office*